US006419598B1

(12) United States Patent
Winter et al.

(10) Patent No.: US 6,419,598 B1
(45) **Date of Patent: *Jul. 16, 2002**

(54) PARALLELOGRAMMIC ADJUSTMENT ASSEMBLY FOR BASKETBALL GOAL SYSTEMS

(75) Inventors: David C. Winter, Layton; Edward G. van Nimwegen, North Ogden; Coplan E. Vaughan, Syracuse, all of UT (US)

(73) Assignee: Lifetime Products, Inc., Clearfield, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/707,262

(22) Filed: Nov. 6, 2000

Related U.S. Application Data

(63) Continuation-in-part of application No. 09/456,802, filed on Dec. 8, 1999, now Pat. No. 6,142,891, which is a continuation of application No. 09/018,231, filed on Feb. 3, 1998, now Pat. No. 6,077,177, which is a continuation-in-part of application No. 08/986,382, filed on Dec. 8, 1997, now Pat. No. 5,879,247, which is a continuation of application No. 08/799,979, filed on Feb. 12, 1997, now Pat. No. 5,695,417.

(51) Int. Cl.[7] ..... A63B 63/08

(52) U.S. Cl. ..... 473/484; 473/483; 473/482; 473/481; 248/283.1; 248/280.11

(58) Field of Search ..... 473/471, 481–484; 248/283.1, 404, 280.11

(56) References Cited

U.S. PATENT DOCUMENTS

| | | | |
|---|---|---|---|
| 276,637 | A | 5/1883 | Slater |
| 1,924,811 | A | 8/1933 | Schulz |
| 2,932,511 | A | 4/1960 | Bemis |

(List continued on next page.)

FOREIGN PATENT DOCUMENTS

| | | |
|---|---|---|
| NL | 28616 | 2/1965 |

OTHER PUBLICATIONS

"Introducing New Huffy Elevator," Information al Brochure, Huffy Sports, Waukesha, Wisconsin (date unknown).
"Adjustable Backstop Support, Backboard and Goal Kit," Informational Brochure, Wilson, Franklin Part, Illinois (date unknown).
"All–in–one" Quick Adjust Kits, Informational Brochure, Porter (date unknown).

(List continued on next page.)

*Primary Examiner*—Raleigh W. Chiu
(74) *Attorney, Agent, or Firm*—Workman, Nydegger & Seeley

(57) ABSTRACT

An adjustable basketball goal system allowing for adjustment of the height of a basketball goal above a playing surface. The basketball goal system including a rigid support pole having a first end, a second opposing end, and an intermediate body portion disposed between the first and second ends. A first parallelogrammic structure configured to pivotally engage the first end of the rigid support. A basketball goal attached to the first parallelogrammic structure. The first deformable parallelogrammic structure may be deformed into a plurality of configurations resulting in an adjustment to the height of the basketball goal above the playing surface corresponding to each configuration. A second parallelogrammic structure, which may also be deformed into a plurality of configurations, includes a first end pivotally connected to the first parallelogrammic structure and a second opposing end configured to pivotally engage the rigid support pole. In operation, selective deformation of the second parallelogrammic structure results in selective deformation of the first parallelogrammic structure, thereby adjusting the height of the basketball goal above the playing surface. A locking mechanism may be operably disposed relative to the second parallelogrammic structure. The locking mechanism being positionable between an engaged position wherein the second parallelogrammic structure is restricted from deforming and a disengaged position wherein the second parallelogrammic structure may be freely deformed.

29 Claims, 12 Drawing Sheets

U.S. PATENT DOCUMENTS

| | | | |
|---|---|---|---|
| 3,427,025 | A | 2/1969 | Procter |
| 3,586,324 | A | 6/1971 | Bearson |
| 3,765,676 | A | 10/1973 | Bearson et al. |
| 3,802,702 | A | 4/1974 | Pulley |
| 4,395,040 | A | 7/1983 | White |
| 4,438,923 | A | 3/1984 | Engle et al. |
| 4,441,709 | A | 4/1984 | Schroeder et al. |
| 4,684,129 | A | 8/1987 | Andersen et al. |
| 4,781,375 | A | 11/1988 | Nye |
| 4,798,381 | A | 1/1989 | Dadbeh |
| 4,801,142 | A | 1/1989 | Friesen |
| 4,805,904 | A | 2/1989 | Nye |
| 4,846,469 | A | 7/1989 | Nye |
| 4,881,734 | A | 11/1989 | Nye |
| 5,133,547 | A | 7/1992 | Pardi |
| 5,158,281 | A | 10/1992 | Williams |
| 5,259,612 | A | 11/1993 | Matherne et al. |
| D350,797 | S | 9/1994 | Curtis |
| 5,388,821 | A | 2/1995 | Blackburn |
| 5,465,957 | A | 11/1995 | Schroeder |
| 5,478,068 | A | 12/1995 | Schroeder |
| 5,503,390 | A | 4/1996 | Hall |
| 5,573,237 | A | 11/1996 | Van Nimwegen et al. |
| 5,573,238 | A | 11/1996 | Aaron et al. |
| 5,601,284 | A | 2/1997 | Blackwell et al. |
| 5,695,417 | A | 12/1997 | Winter et al. |
| 5,720,679 | A | 2/1998 | Schroeder |
| 5,738,601 | A | 4/1998 | Hughes |
| 5,879,247 | A | 3/1999 | Winter et al. |
| 6,077,177 | A * | 6/2000 | Winter et al. ..... 473/484 |
| 6,142,891 | A | 11/2000 | Winter et al. |

OTHER PUBLICATIONS

"Component Play Grounds", Equipment Brochure, Salt Lake City, Utah, p. 6 (date unknown).

Diversified Products, "DP Fit for Life," 1990 Equipment Catalog, Opelika, Alabama, p. 61.

Huffy Sports, "Basketball's Hottest Products this Year," Equipment Catalog. Waukesha, Wisconsin (date unknown).

Huffy Sports, Equipment Catalog, Waukesha, Wisconsin, p. 21 (date unknown).

Diversified Products, "25 Years of Innovation," Opelika, Alabama, p. 69 (date unknown).

Huffy Sports, "Our All–Star Lineup," Waukesha, Wisconsin, p. 21 (date unknown).

Harvard,"1988 Sporting Goods Catalog," p. 8.

Huffy Sports, Equipment Assembly Instruction Sheet, Waukesha, Wisconsin, (date unknown).

* cited by examiner

PARALLELOGRAMMIC ADJUSTMENT ASSEMBLY FOR BASKETBALL GOAL SYSTEMS

RELATED U.S. APPLICATIONS

This application is a continuation-in-part of application Ser. No. 09/456,802 filed Dec. 8, 1999 and entitled ADJUSTABLE BASKETBALL GOAL SYSTEM now U.S. Pat. No. 6,142,891 which is a continuation of application Ser. No. 09/018,231, filed Feb. 3, 1998 and entitled ADJUSTABLE BASKETBALL GOAL SYSTEM, now issued as U.S. Pat. No. 6,077,177, which is a continuation-in-part of application Ser. No. 08/986,382, filed Dec. 8, 1997 and entitled POWER LIFT BASKETBALL ADJUSTMENT SYSTEM, now issued as U.S. Pat. No. 5,879,247, which is a continuation of application Ser. No. 08/799,979, filed Feb. 12, 1997 and entitled POWER LIFT BASKETBALL ADJUSTMENT SYSTEM, now issued as U.S. Pat. No. 5,695,417, which are hereby incorporated herein by reference.

BACKGROUND

1. The Field of the Invention

The present invention is related to a system for adjusting the height of a basketball goal. More particularly, the present invention is related to a counterbalanced basketball adjustment system having an adjustment handle which permits the quick release and easy repositioning of the basketball goal using minimal effort.

2. Technical Background

Basketball is an increasingly popular sport in the United States and abroad. There are many cities, counties, and other associations that sponsor recreational and instruction leagues where people of all ages can participate in the sport of basketball. Today there are organized leagues for children as young as five and six years old. Accordingly, it is not surprising that more and more people have a basketball goal mounted on their property.

Some basketball goals are adjustable which allows people of all ages and sizes to enjoy the sport because the basketball goal can be positioned at a height lower than the standard height of ten feet. The adjustability of basketball goals has been especially beneficial to children. Many younger children simply do not have the strength to make a basket at the standard height of ten feet. Other children have had to heave the basketball at the higher goal in order to make a basket and in so doing develop improper shooting skills. Additionally, nonadjustable goals sometimes frustrate children and cause them to lose their confidence because the basketball goals are simply too high for children to consistently make a basket. This frustration sometimes causes children to ultimately give up the game.

Many attempts have been made to design a basketball goal which is adjustable to several different heights. Some of these designs employ pivotally mounted parallel bars which connect the basketball backboard to a rigid mounting device such as a pole. The parallel bars combine with the basketball backboard and the rigid mounting device to form a parallelogram. Since the bars are pivotally mounted, they allow the backboard of the basketball goal to move to several different heights while remaining vertically disposed.

In some basketball adjustment systems, once the basketball goal is at the desired height, it is secured in place by tightening one or more bolts which "lock" the parallelogram in place. One of the disadvantages of these devices is that whenever one desires to adjust the basketball goal, it requires the use of a ladder or similar device to enable one to reach the one or more bolts which must be loosened to "unlock" the basketball goal. This is complicated by the fact that when the bolt or bolts are loosened, the person adjusting the goal must support the entire weight of the goal until the goal has been set to the desired height and the bolt or bolts are tightened again. Still other systems are difficult to "unlock" and readjust without the use of both hands and often times coordinated efforts of more than one person.

Other adjustable basketball goals have adjustment systems that are only accessible with the use of a ladder or require the person adjusting the goal to use a long rod or pole to manipulate the adjustment system. Many of these systems also require the person adjusting the goal to support the entire weight of the goal while the height of the goal is being adjusted.

Other adjustable basketball goals are configured such that the weight of the basketball goal bears directly on the adjustment system. For example, one such device uses a crank system that can be turned to shorten or lengthen a post attached to a parallelogrammic structure to deform the parallelogrammic structure and change the height of a basketball goal attached to the structure. The weight of the goal bears directly on the post that is threaded through the crank system.

There are several disadvantages to this type of design. One disadvantage is that with the weight of the goal bearing on the crank system, the crank is relatively hard to turn. Another disadvantage is that it takes several turns of the crank to make an adjustment to the height of the goal of a few feet. Thus, for example, an adjustment from eight feet to ten feet may take a significant amount of time and effort.

These disadvantages are particularly troublesome for children who typically possess less strength and patience than adults. This is unfortunate because it is usually small children who have the greatest need for lowering the basketball goal.

A further disadvantage of some adjustable basketball systems is that once the height of the goal is changed from the standard height often feet, it is difficult to reposition the goal to that precise height without a measuring device.

From the foregoing, it will be appreciated that it would be an advancement in the art to provide a basketball adjustment system that can be adjusted without the use of a ladder or a pole. It would be a further advantage to provide such a basketball adjustment system that could be adjusted quickly and with minimal effort so that even a child could adjust it with minimal effort. It would be an additional advantage to provide a way to easily position the goal at a predetermined height above the playing surface.

Such a basketball goal is disclosed and claimed herein.

BRIEF SUMMARY OF THE INVENTION

The present invention is directed to a novel adjustable basketball goal system allowing for adjustment of the height of a basketball goal above a playing surface. The basketball goal system of the present invention includes a rigid support which extends in a substantially upward direction. The rigid support has a goal side and a back side opposite the goal side.

A first deformable parallelogrammic structure is pivotally attached to the goal side of the rigid support such that the first parallelogrammic structure is suspended above the playing surface. The first parallelogrammic structure includes an upper support and a lower support. In one embodiment, one of the supports has a tail section which extends beyond the back side of the rigid support.

A second deformable parallelogrammic structure is pivotally attached to the back side of the rigid support and is pivotally connected to the first deformable parallelogrammic structure such that deformation of the second deformable parallelogrammic structure selectively deforms the first deformable parallelogrammic structure. In one embodiment, the second deformable parallelogrammic structure is pivotally connected to the first deformable parallelogrammic structure by means of the tail section of one or more of the upper and/or lower supports.

A basketball goal may be attached to the first parallelogrammic structure. In one embodiment, the basketball goal consists of a rim and backboard. The first parallelogrammic structure is configured such that as the first parallelogrammic structure deforms, the height of the basketball goal above the playing surface changes, each height corresponding to a different deformation. Since the supports are pivotally mounted, they allow the backboard of the basketball goal to move to several different heights while remaining vertically disposed.

The second deformable parallelogrammic structure includes an adjustment lever pivotally mounted to the back side of the rigid support below the first parallelogrammic structure and an extension arm having a length positioned between the first parallelogrammic structure and the adjustment lever. Preferably, one end of the extension arm is pivotally attached to the tail section of the upper and lower supports and the other end of the extension arm is pivotally attached to the adjustment lever. This allows movement of the adjustment lever to deform both the second parallelogrammic structure and the first parallelogrammic structure and thereby adjust the height of the basketball goal above a playing surface. Thus, the height of the basketball goal can be adjusted without the use of a ladder or other adjustment implement.

In one embodiment, the adjustable basketball system of the present invention preferably includes a lockable piston assembly. The lockable piston assembly is attached to the rigid support and to the adjustment lever. The piston assembly includes a switch which is moveable between a locked position and an unlocked position. The switch is biased toward the locked position. In the locked position, the piston of the piston assembly is prevented from movement within the piston housing. In the unlocked position, the piston can move freely within the piston housing.

The piston assembly also acts as a counterbalance to offset the weight of the basketball goal during adjustment. The piston assembly is attached to the rigid support such that when the switch is in the unlocked position the piston assembly provides a force on the adjustment lever in the opposite direction of the force acting on the adjustment lever due to the weight of the basketball goal. The piston force is preferably substantially equal to the force exerted upon the adjustment lever by the weight of the basketball goal such that the forces substantially cancel each other. In this condition, the height of the basketball goal can be adjusted quickly and with minimal effort, even by a child.

An actuation trigger is preferably pivotally attached to the adjustment lever such that when one end of the actuation trigger is depressed, the other end engages the piston switch forcing the switch into the unlocked position. The actuation trigger is attached to the adjustment lever such that the trigger can be activated with the same hand that adjusts the adjustment lever. This configuration further adds to the ease with which the height of the basketball goal can be adjusted.

In a preferred embodiment of the present invention, the basketball adjustment system includes an adjustment stop attached to the rigid support. The adjustment stop is positioned to engage the first parallelogrammic structure when the basketball goal reaches a predetermined height and prevent the basketball goal from being positioned lower than the predetermined position. In a preferred embodiment, adjustment stops are positioned to limit the range of heights at which the basketball goal can be positioned at both an upper and lower end. Thus, the present invention provides a measure of safety in that the basketball goal cannot collapse below a certain point. Additionally, a person can place an upper adjustment stop such that the first parallelogrammic structure will engage the stop when the basketball goal is at the standard height of ten feet. Thus, the present invention offers the advantage of being easily repositioned at the standard height after shooting baskets at a lower height.

In another preferred embodiment, a locking rod is pivotally attached at one end to the rigid support. The other end of the locking rod is positioned within, and slidably engages, a U-shaped housing. As the U-shaped housing slides along the length of the locking rod, the extension arm moves to selectively to correspondingly deform the second parallelogrammic structure and the first parallelogrammic structure. Thus, the basketball goal can be adjusted by sliding the housing along the locking rod. Movement of the housing is facilitated by means of an adjustment handle pivotally attached to the housing.

In one embodiment, the extension arm, and thus the basketball goal, is held in place through the use of locking plates positioned within the U-shaped housing. The locking plates are each configured with an opening through which the locking rod is positioned. These openings are larger than the diameter of the locking rod. Thus, the locking plates can be positioned in a non-perpendicular angle relative to the locking rod. In this configuration, the locking plates bind with the locking rod and prevent the housing from moving relative to the locking rod.

The plates are positioned between the opposing sides of the U-shaped housing and are thus prevented from moving laterally or pivoting about the locking rod. The housing is also configured with a pair of stops. Each stop is positioned to engage a first end of one of the locking plates. In one preferred embodiment, a biasing spring is positioned about the locking rod between the locking plates. As the biasing member engages each locking plate, the locking plates pivot about the respective stops into a non-perpendicular position relative to the locking rod. When the system is at rest, the biasing member biases the locking plates into a non-perpendicular angle relative to the locking rod substantially preventing the housing from moving relative to the locking rod.

The adjustment handle is configured with a pair of tabs, each of which engage a second end of a respective locking plate. The adjustment handle is configured to move between a rest position, wherein each locking plate is in a non-perpendicular position relative to the locking rod, and an engaged position, wherein each tab engages a respective locking plate, forcing it into a substantially perpendicular position relative to the locking rod. This allows the locking plate, and consequently the housing to move relative to the locking rod. Thus, it is an advantage of the present invention to be able to "unlock" the system and simultaneously adjust the height of the basketball goal with the use of the same hand.

The system is preferably counterbalanced with a counterbalancing spring attached within the first parallelogrammic structure. The counterbalance spring provides a force which substantially counterbalances the gravitational force acting on the adjustable basketball goal system due to the weight of the basketball goal. Thus, it is an advantage of the present invention that repositioning of the basketball goal only requires minimal force.

These and other advantages of the present invention will become more filly apparent by examination of the following description of the preferred embodiments and the accompanying drawings.

BRIEF DESCRIPTION OF THE DRAWINGS

To better understand the invention, a more particular description of the invention will be rendered by reference to the appended drawings. These drawings only provide information concerning typical embodiments of the invention and are not to be considered limiting of its scope. The invention will be described and explained with additional specificity and detail through the use of the accompanying drawings, in which.

DETAILED DESCRIPTION OF THE PREFERRED EMBODIMENTS

Figure 1:
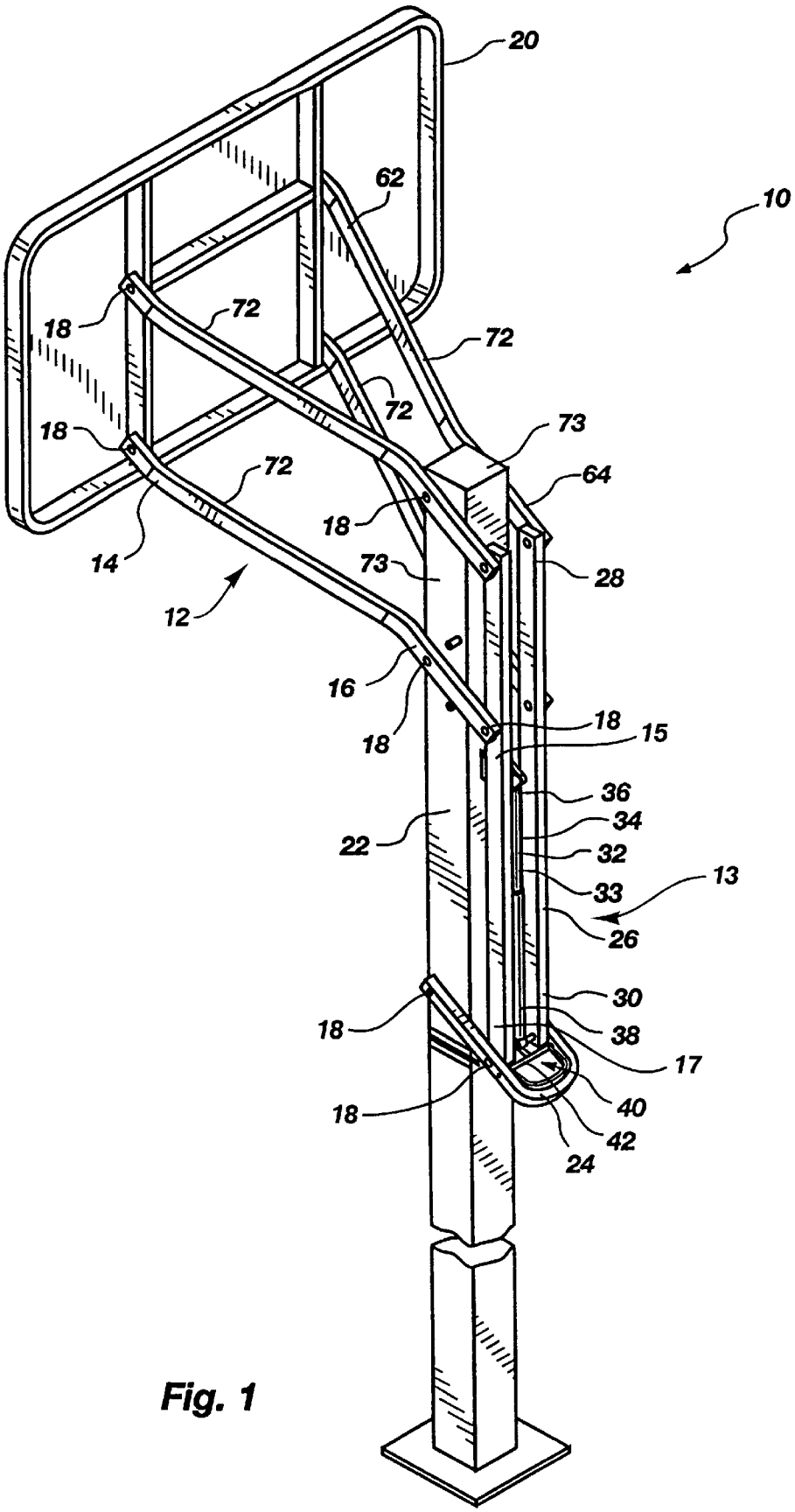
FIG. 1 is a perspective view of one embodiment of the adjustable basketball goal system of the present invention.

Reference is now made to the figures wherein like parts are referred to by like numerals throughout. With particular reference to FIG. 1, an adjustable basketball goal system according to the present invention is generally designated at 10.

The goal system 10 includes a first deformable parallelogrammic structure 12, which is deformable into a plurality of configurations. The first deformable parallelogrammic structure 12 has a first end 14 and a second end 16. The first end 14 includes means for securing the first deformable parallelogrammic structure 12 to a basketball goal.

In one presently preferred embodiment, the means for securing the first deformable parallelogrammic structure 12 to the basketball goal comprises bolts 18 positioned through openings (not shown) disposed within the first end 14 of the first parallelogrammic structure 12 and within a corresponding hole (not shown) disposed within a frame 20 to which a backboard and rim may be attached. The second end 16 of the first deformable parallelogrammic structure 12 includes means for securing the first deformable parallelogrammic structure 12 to a rigid support 22 such that the first deformable parallelogrammic structure 12 is suspended above the playing surface. In a presently preferred embodiment, the means for securing the first deformable parallelogrammic structure 12 to the rigid support 22 consists of bolts 18 positioned with corresponding holes (not shown) within the second end 16 of the first deformable parallelogrammic structure 12 and within the rigid support 22. It will be appreciated by persons skilled in the art that there are alternative ways to attach the first parallelogrammic structure 12 between a basketball goal and the rigid support 22. These ways may include pins or pivotal brackets.

Similarly, the goal system 10 of the present invention includes a second deformable parallelogrammic structure 13, which is deformable into a plurality of configurations. The second deformable parallelogrammic structure 13 has a first end 15 and a second opposing end 17. Preferably, the first end 15 is adapted to pivotally attach the second deformable parallelogrammic structure 13 to the first deformable parallelogrammic structure 12 and the second opposing end 17 is adapted to be pivotally engage the rigid support 22.

In one presently preferred embodiment, the means for securing the second deformable parallelogrammic structure 13 to the rigid support 22 and to the first deformable parallelogrammic structure 12 comprises bolts 18 positioned through openings (not shown) disposed at the first end 15 of the second parallelogrammic structure 13 and within corresponding holes (not shown) formed in the first parallelogrammic structure 12. The second opposing end 17 of the second deformable parallelogrammic structure 13 is adapted to pivotally engage the rigid support 22. In one presently preferred embodiment, the means for securing the second deformable parallelogrammic structure 13 to the rigid support 22 consists of bolts 18 positioned within corresponding holes (not shown) formed at the second end 17 of the second deformable parallelogrammic structure 13 which act as pivotal axis. As appreciated by those skilled in the art there are alternative ways to attach the second parallelogrammic structure 13 between the rigid support 22 and the first parallelogrammic structure. These ways may include pins or pivotal brackets.

Figure 2:
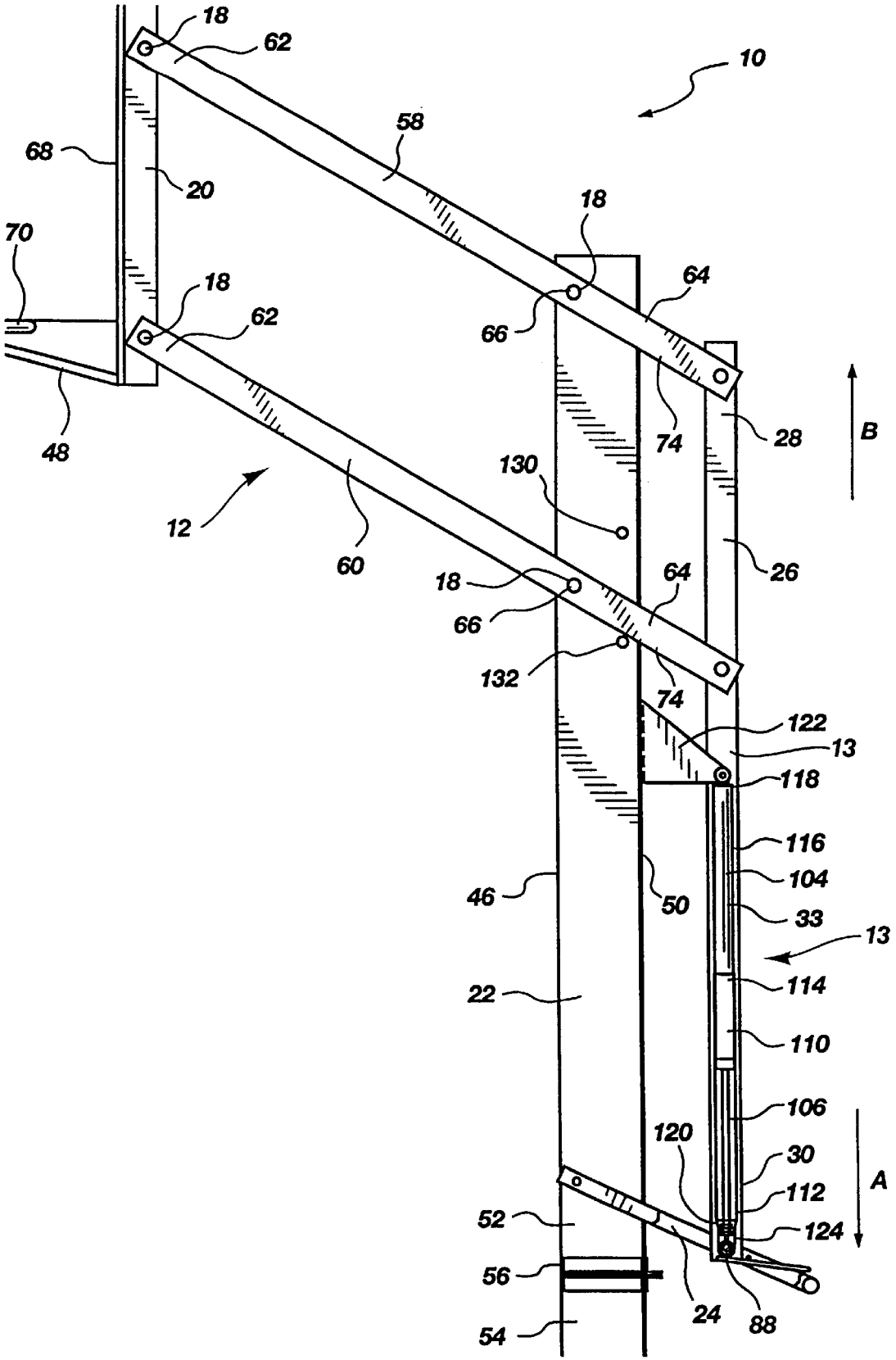
FIG. 2 is a side partial cross sectional view of the adjustable basketball goal system of FIG. 1.

As best shown in FIGS. 1 and 2, the second deformable parallelogrammic structure may include an adjustment lever 24 pivotally mounted to the rigid support 22 and at least one extension arm 26 pivotally connected between the first parallelogrammic structure 12 and the adjustment lever 24 such that movement of the adjustment lever 24 causes deformation of both the second parallelogrammic structure 13 and the first parallelogrammic structure 12. As will be discussed in greater detail below, the adjustment lever 24 can be manipulated by a user so as to result in the deformation of the second parallelogrammic structure 13 and, correspondingly, the first parallelogrammic structure 12 into a variety of configurations corresponding to various heights of the basketball goal above the playing surface.

The goal system 10 includes means 32 for restricting the deformation of the first parallelogrammic structure 12 at any one of the plurality of configurations such that the basketball goal is suspended above the playing surface at one of a plurality of heights. The means 32 for restricting the deformation has an engaged position wherein the first parallelogrammic structure 12 is restricted from deforming and a disengaged position wherein the first parallelogrammic structure 12 may be freely deformed allowing the height of the basketball goal to be altered. As will be discussed in greater detail below, the means 32 for restricting the deformation of the first parallelogrammic structure 12 in the preferred embodiment comprises a lockable piston assembly 33.

The goal system 10 also includes a biasing or counterbalance member 34 which includes a first end 36 and a second end 38. In one embodiment, the first end 36 of the counterbalance member 34 is attached to the rigid support 22 and the second end 38 of the counterbalance member 34 is attached to the adjustment lever 24. The counterbalance member of the preferred embodiment comprises the same lockable piston assembly 33 used to restrict the deformation of the first parallelogrammic structure 12. The counterbalance member 34 is positioned such that when the restricting means 32 is in the disengaged position, the counterbalance member 34 provides a force on the adjustment lever 24 in the opposite direction of the force acting on the adjustment lever 24 due to the weight of the basketball goal. This configuration minimizes the force required to adjust the basketball goal.

It will be appreciated by those of skill in the art that one or more counterbalance members 34 may be attached in a variety of ways to minimize the force required to adjust the basketball goal. These ways may include, but are not limited to attaching one end of the biasing member to the rigid support and the other end of the counterbalance member to the first deformable parallelogrammic structure 12 or to the extension arm 26.

The goal system 10 also includes releasing means 40 for moving the restricting means 32 from the engaged position to the disengaged position. In one preferred embodiment, the releasing means comprises an actuation trigger 42. As will be discussed in detail below, the actuation trigger 42 is positioned for engagement with the restricting means such that when the actuation trigger 42 is engaged, the restricting means moves from the engaged position to the disengaged position allowing the height of the basketball goal to be adjusted.

With reference now to FIG. 2, a cross-sectional view of the piston of the preferred embodiment of the present invention is shown. The adjustable basketball goal system 10 includes a rigid support 22 extending in a substantially upward direction. The rigid support 22 has a goal side 46 adjacent a basketball goal 48 and a back side 50 opposite the goal side 46. The rigid support comprises at least two pole sections 52 and 54 capable of being secured to each other. The embodiment of the rigid support 22 illustrated in FIG. 2 shows the rigid support 22 having an upper section 52 and a lower section 54 secured together with plates 56. In one presently preferred embodiment, each section 52 and 54 includes an abutment plate 56 secured to one end of each support section 52 and 54 such that the abutment plates 56 can be positioned next to each other and such that the abutment plates 56 can be bolted together to secure the support sections 52 and 54 to each other. This configuration allows the support sections 52 and 54 of the rigid support 22 to be packaged in a much smaller container while still providing the desired rigidity when secured together to support the first parallelogrammic structure 12.

In one presently preferred embodiment, the rigid support 22 has a square crosssection which provides added strength to the rigid support 22 and also provides a flat surface to which the first deformable parallelogrammic structure 12 may be attached.

It will be appreciated by those of skill in the art that there are many ways known in the art in which to configure a rigid support for suspending a basketball goal 48 above a playing surface. For example, a one-piece or multi-piece pole with a circular cross-section may be used. It will further be appreciated that there are multiple ways known in the art to secure rigid support sections together.

Referring still to FIG. 2, the first deformable parallelogrammic structure 12 of the adjustable basketball goal system 10 comprises an upper support 58 and a lower support 60. The upper and lower supports, 58 and 60 each have a first end 62 and a second end 64. In a presently preferred embodiment, the first end 62 of the upper and lower supports 58 and 60, are pivotally attached to a basketball frame 20 by means of bolts 18 positioned through corresponding openings within the first end 62 of the upper and lower supports 58 and 60, and openings within the frame 20. The upper and lower supports 58 and 60, are each pivotally attached to the rigid support 22 at a pivot point 66 adjacent the second ends 64 of the supports 58 and 60. In one presently preferred embodiment, the upper and lower supports 58 and 60, are pivotally attached to the rigid support 22 by positioning bolts 18 through corresponding openings within the second end 64 of the upper and lower supports 58 and 60 adjacent the pivot point 66 and within openings in the rigid support 22.

The basketball goal 48 of the present invention comprises a backboard 68 and a rim 70. The backboard 68 is attached to the frame 20. It will be appreciated by those of skill in the art that a variety of goals may be used which would provide an opening through which a basketball may pass.

The upper support 58, lower support 60, rigid support 22, and frame 20 define the first deformable parallelogrammic structure 12. In the presently preferred embodiment of FIG. 2, the rigid support 22 is substantially vertical to a playing surface and the backboard 68 is positioned substantially parallel to the rigid support 22. The rim 70 is positioned to be substantially horizontal. Because the upper support 58 and the lower support 60 are pivotally mounted at each end 62 and 64, the first parallelogrammic structure 12 can be deformed to reposition the height of the basketball goal 48 while allowing the backboard 68 and rim 70 to remain vertically and horizontally disposed, respectively.

With brief reference to FIG. 1, the upper and lower supports 58 and 60, each comprise adjacent bars 72. The bars 72 are bent such that the bars 72 converge from the first end 62 of the upper and lower supports 58 and 60, where the bars 72 are attached to the frame 20 to the second end 64 of the upper and lower supports 58 and 60, where the bars 72 15 are attached to opposite sides 73 of the rigid support 22. It will be appreciated by those of skill in the art that the upper and lower supports, 58 and 60 may be configured in a variety of ways so long as the parallelogrammic configuration, which allows the height of the basketball goal 48 to be adjusted, is maintained.

Referring again to FIG. 2, in one preferred embodiment, at least one of the supports 58 and 60, includes a tail section 74 which extends beyond the rigid support 22 at the back side 50 of the rigid support 22 adjacent the second end 64 of said support. In a preferred embodiment, both of the upper and lower supports 58 and 60 have a tail section 74 which extends beyond the back side 50 of the rigid support 22.

The tail section 74, the adjustment lever 24, a portion of the length of the rigid support 22, and the extension arm 26, in combination, define the structural components of the second deformable parallelogrammic structure 13. Structurally, the tail sections 74 of the upper and lower supports 58, 60 provide a point of pivotal contact to connect the first parallelogrammic structure 12 to the second deformable parallelogrammic structure 13 and for adjustable communication with the adjustment lever 24. The adjustment lever 24 is preferably pivotally mounted adjacent the back side 50 of the rigid support 22. Being located on the back side 50 of the rigid support 22, the adjustment lever 24 is less likely to interfere with basketball play.

As illustrated in FIG. 2, one presently preferred embodiment of the adjustment lever 24 of the second parallelogrammic structure 13 is connected to the first parallelogrammic structure 12 by at least one extension arm 26, which obviates the need for a ladder, pole, or separate adjustment tool. Preferably, two extension arms 26 are connected between the adjustment lever 24 and the first parallelogrammic structure 12. Each of the extension arms 26 has a first end 28 and a second end 30. In one embodiment, the first end 28 of the extension arm 26 is pivotally attached to the tail section 74 of one of the upper or lower supports, 58 and 60. In a presently preferred embodiment, the first end 28 of the extension arm 26 is attached to tail section 74 of both the upper and lower supports, 58 and 60. The second end 30 of the extension arm 26 is pivotally attached to the adjustment lever 24 such that the extension arm 26 is substantially parallel to the rigid support 22 adjacent the back side 50 of the rigid support 22.

Figure 3:
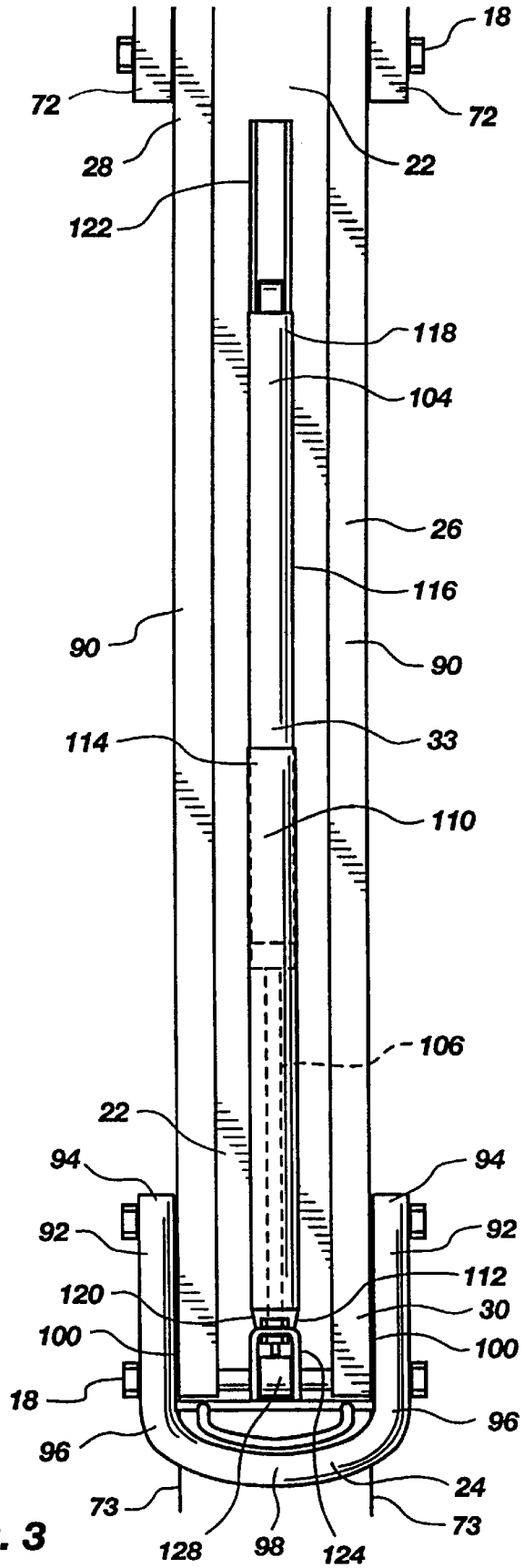
FIG. 3 is a back plan view of a portion of the adjustable basketball goal system of FIG. 1.

With reference now to FIG. 3, the extension arm 26 includes two substantially parallel bars 90. The substantially parallel bars 90 are pivotally attached at the first end 28 of the extension arm 26 to the adjacent bars 72 of the upper and lower supports, 58 and 60. The adjustment lever 24 includes a U-shaped member having side sections 92. A first end 94 of the side sections 92 is attached to opposite sides 73 of the rigid support 22. A curved section 98 of the U-shaped adjustment lever 24 connects the second ends 96 of the side sections 92. The substantially parallel bars 90 are pivotally attached at the second end 30 of the extension arm 26 to an inside surface 100 of the side sections 92 of the U-shaped adjustment lever 24 adjacent the second end 96 of each side section 92. The parallel bars 90 of the extension arm 26 are pivotally attached to the adjacent bars 72 of the upper and lower supports 58 and 60 adjacent the tail sections 74 and to the side sections 92 of the adjustment lever 24 by means of bolts 18 positioned through corresponding openings in the parallel bars 90 and the adjacent bars 72 and through corresponding openings in the parallel bars 90 and the side sections 92.

It will be appreciated by those of skill in the art that the adjustment lever 24 of the present invention can be configured in a variety of ways to obtain the lever action utilized in the present invention. It will also be appreciated that the extension arm 26 can be configured in a variety of ways and still be able to link the first deformable parallelogrammic structure 12 to the adjustment lever 24 of the second deformable parallelogrammic structure 13 at a location accessible to basketball players of all ages.

Figure 4:
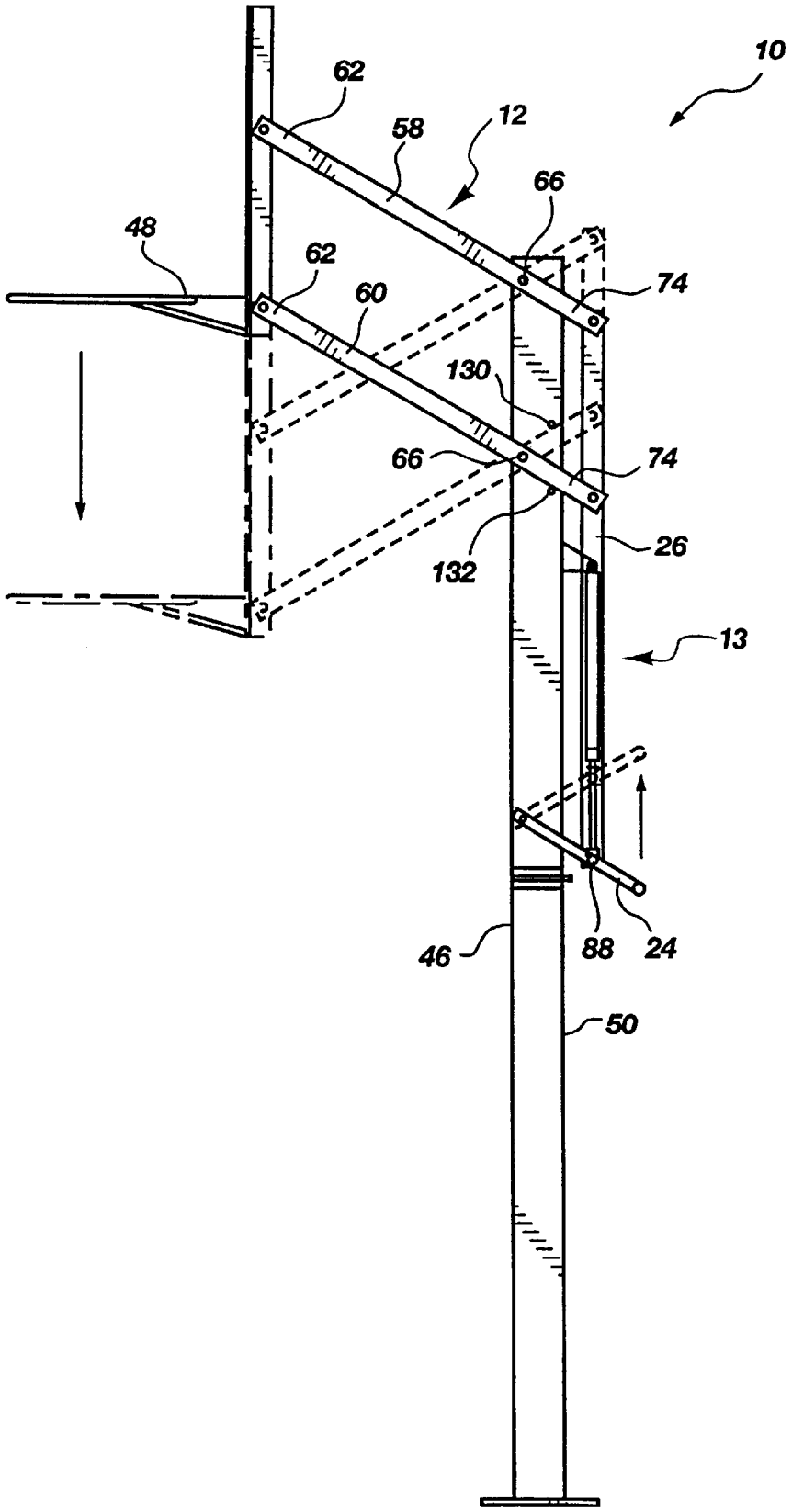
FIG. 4 is a side plan view of the adjustable basketball goal system of FIG. 1 showing an alternative position for the basketball goal in phantom lines.

With reference now to FIG. 4, the second deformable parallelogrammic structure 13 communicates with the first deformable parallelogrammic structure 12. The extension arm 26 of the second deformable parallelogrammic structure 13 enables communication between the adjustment lever 24 and the first deformable parallelogrammic structure 12. In operation, the second deformable parallelogrammic structure 13 is deformable through a range of configurations with each configuration of the second parallelogrammic structure 13 corresponding to one of a variety of configurations of the first parallelogrammic structure 12. At each configuration, the basketball goal 48 is disposed at a different height above the playing surface.

It will be appreciated by those of skill in the art that basketball goal 48 and the extension arm 26 are positioned at a distance from the rigid support 22 such that the point of attachment 88 between the extension arm 26 and the adjustment lever 24 and the pivot points 66 act as fulcrums and the adjustment lever 24 and the upper and lower supports 58 and 60 act as levers. This positioning provides the system with a mechanical advantage, in which a relatively small movement of the adjustment lever 24 causes a correspondingly larger movement of the basketball goal 48.

The extension arm 26 is positioned to remain substantially parallel to the rigid support 22 as the height of the basketball goal 48 is adjusted. Thus, there is little danger of an arm or other limb becoming wedged or pinched between the extension arm 26 and the rigid support 22 because there is no scissor action between the extension arm 26 and the rigid support 22.

It will be appreciated by those of skill in the art, that the adjustment lever 24 may be positioned adjacent the goal side 46 of the rigid support 22. In this embodiment, the upper support 58 and lower support 60 need not have a tail section 74 because the extension arm 26 could be attached to the supports 58 and 60 between the pivot points 66 and the first end 62 of each support, 58 and 60. It will further be appreciated by those of skill in the art that positioning the adjustment lever 24 adjacent the goal side 46 of the rigid support 22 may interfere with basketball play.

With reference now to FIGS. 2 and 3, the adjustable basketball goal system 10 includes a lockable piston assembly 33 used to restrict the deformation of the first parallelogrammic structure 12 at any one of a plurality of configurations. The lockable piston assembly 33 includes a piston housing 104, a piston (not shown) sidably located within the piston housing 104, and a rod 106 attached to the piston. As can best be seen by reference to FIGS. 5 and 6, the lockable piston assembly 33 includes a switch 108 which is moveable between a locked position, in which the piston is prevented from movement within the piston housing 104, and an unlocked position, in which the piston is movable within the piston housing 104. The switch 108 is preferably biased toward the locked position. The lockable piston assembly 33 of the present invention uses a combination of gas and fluid for adjustment in both directions and may include any of those commercially available lockable piston assemblies known for such use.

Referring again to FIGS. 2 and 3, the adjustable basketball goal system 10 of the present invention also includes a shroud 110. The shroud 110 is in telescopic engagement with the piston housing 104. A first end 112 of the shroud 110 is attached to the rod 106.

As the rod 106 moves within the piston housing 104, a second end 114 of the shroud 110 movably engages an outside surface 116 of the piston housing 104. In this configuration, the lockable piston assembly 33 is strengthened and prevented from buckling under the rigors of basketball play, which sometimes include people hanging from the rim.

The lockable piston assembly 33 includes a first end 118 adjacent the piston housing 104 and a second 120 end adjacent the rod 106. The first end 118 of the lockable piston assembly 33 is attached to a bracket 122 which is affixed to the rigid support 22. The second end 120 of the lockable piston assembly 33 is preferably configured with a U-shaped mounting piece 124 secured to the shroud 110 such that the switch 108 is exposed within the U-shaped mounting piece 124. The U-shaped mounting piece 124 has openings through which the bolt 18 used to pivotally secure the extension arm 26 to the adjustment lever 24 passes. Thus, the rod 106 moves in association with the movement of the adjustment lever 24. It will be appreciated that the second end 120 of the lockable piston assembly 33 could be attached to either the extension arm 26, or the adjustment lever 24, without being attached to both with one bolt 18.

In one presently preferred embodiment, the lockable piston assembly 33 is positioned between parallel bars 90 of the extension arm 26. This configuration provides the lockable piston assembly 33 with protection against being hit by the basketball or other object.

Referring now to FIG. 2, the lockable piston assembly 33 also serves as a counterbalance member which counterbalances the weight of the basketball goal 48. It will be appreciated that the weight of the basketball goal 48 exerts a gravitational force on the adjustable basketball goal system 10. For example, the gravitational force will pull basketball goal 48 toward the playing surface. Thus, because of the pivotal attachment of the first parallelogrammic structure 12 to the rigid support 22, an upward force will be exerted on the extension arm 26, and the adjustment lever 24. When the switch 108 is in the unlocked position, the piston assembly provides a force A on the adjustment lever 24 in the opposite direction of the gravitational force B acting on the adjustment lever 24 through the extension arm 26 due to the weight of the basketball goal 48.

In a preferred embodiment, the piston force A is substantially equal to the gravitational force B exerted upon the adjustment lever 24 by the weight of the basketball goal 48. Thus, the forces substantially cancel each other allowing the height of the basketball goal 48 to be adjusted with minimal effort.

The lockable piston assembly 33 of the preferred embodiment loses approximately 2% of its biasing strength annually. However, the initial amount of force A exerted by the piston assembly can be preset at the time of assembly of the adjustable basketball goal system 10. Thus, depending upon the anticipated life of the lockable piston assembly 33, the force A can be set to be slightly greater than the gravitational force B exerted by the weight of the basketball goal 48. As the piston force A gradually depreciates over the lifetime of the lockable piston assembly 33, the piston force A will eventually become slightly less than the gravitational force B. Accordingly, with force A being greater than force B initially, the basketball goal 48 will tend to float upwardly when the switch 108 is in the unlocked position. Later in time, when force A is less than force B, the basketball goal 48 will tend to float downwardly when the switch 108 is in the unlocked position. It will be appreciated by those of skill in the art that the system can be set up such that the differences between the forces (A minus B) and (B minus A) will be minimal over a substantial period of time. Thus, during this time, the forces will substantially counterbalance each other and any resulting force in either direction can easily be overcome by the user moving the adjustment lever 24, even if that user is a child.

It will be appreciated by those of skill in the art that the lockable piston assembly 33 can be positioned in a variety of places to accomplish the teachings of the this invention. For example, if the adjustment lever 24 were positioned adjacent the goal side 46 of the rigid support 22 the lockable piston assembly 33 might be attached to the rigid support 22 below the adjustment lever 24. Further, the lockable piston assembly 33 could be attached to the upper and lower supports 58 and 60 of the first deformable parallelogrammic structure 12 and still create a force A component which would counterbalance the gravitational force B indirectly exerted on the adjustment lever 24 by the weight of the basketball goal 48.

It will also be appreciated by those of skill in the art that the lockable piston assembly 33 may be oriented to push or pull against a desired piece to achieve the counterbalancing effect. In the preferred embodiment, the lockable piston assembly 33 is oriented with the piston housing 104 positioned above the rod 106. It will be appreciated that in this configuration, gravity may direct fluids located within the piston housing 104 into engagement with a grommet (not shown) centering the rod 106 within the housing, thus making the piston self-lubricating.

It will also be appreciated that a combination of springs or pistons may used which each have a force component in the opposite direction of the gravitational force B such that when the force components are combined, the sum is substantially equal to, and opposite, force B. For example, a biasing spring may be located within the first deformable parallelogrammic structure 12 creating a force component in the opposite direction to force B such that the lockable piston assembly 33 need not exert as much force in that same direction. It will further be appreciated that if the counterbalance member, whether a spring, piston assembly, or other member, is contained completely in the first deformable parallelogrammic structure 12, the extension arm 26 would not be under constant tension as it is in the preferred embodiment, and could be constructed from lesser strength material. The embodiment illustrated in the drawings is preferred for its efficiency of design, its strength, and its aesthetic look.

Figure 5:
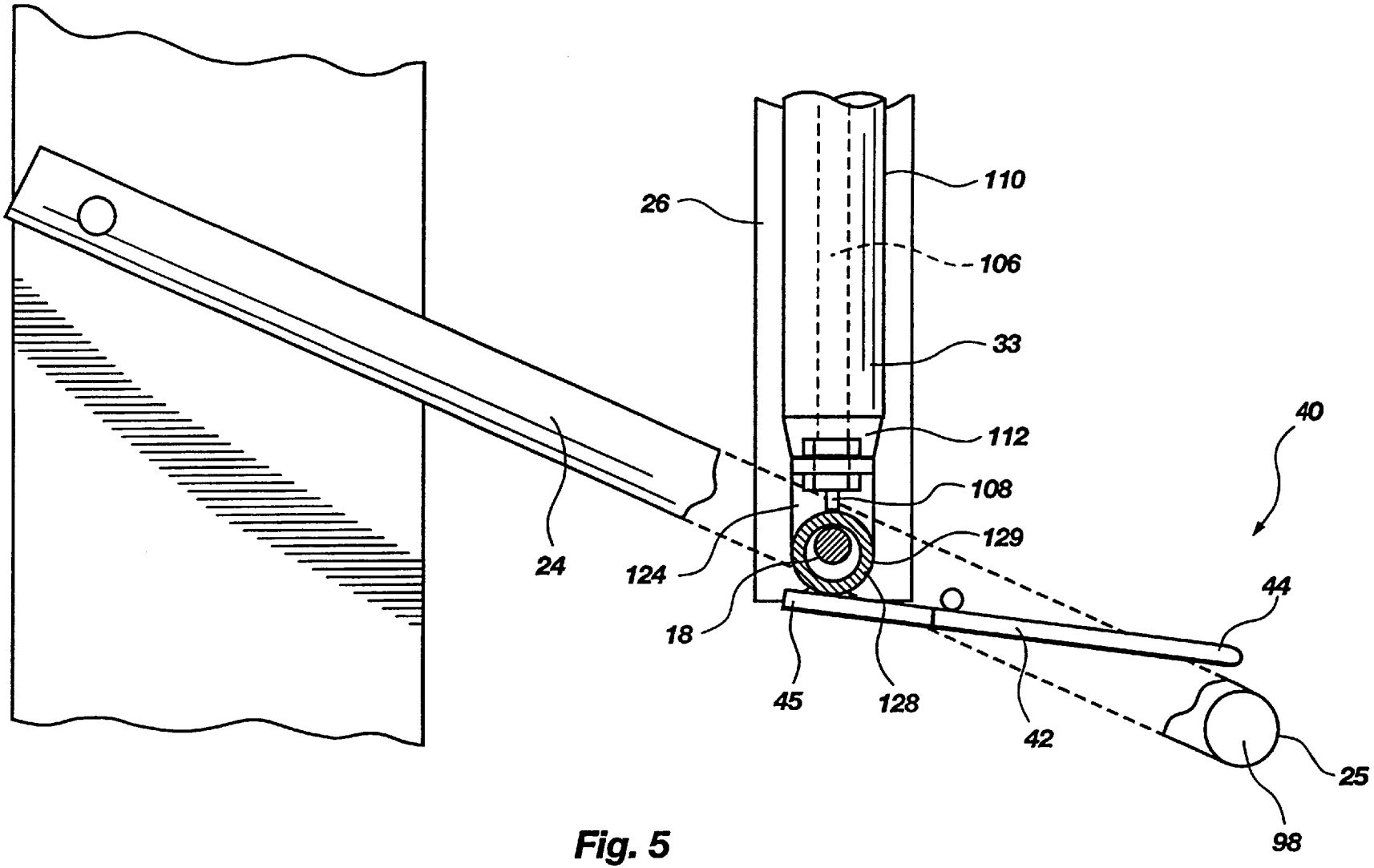
FIG. 5 is a partially cut away, cross sectional view of the adjustment lever of the adjustable basketball goal system of FIG. 1 with the actuation trigger in the rest position.
Figure 6:
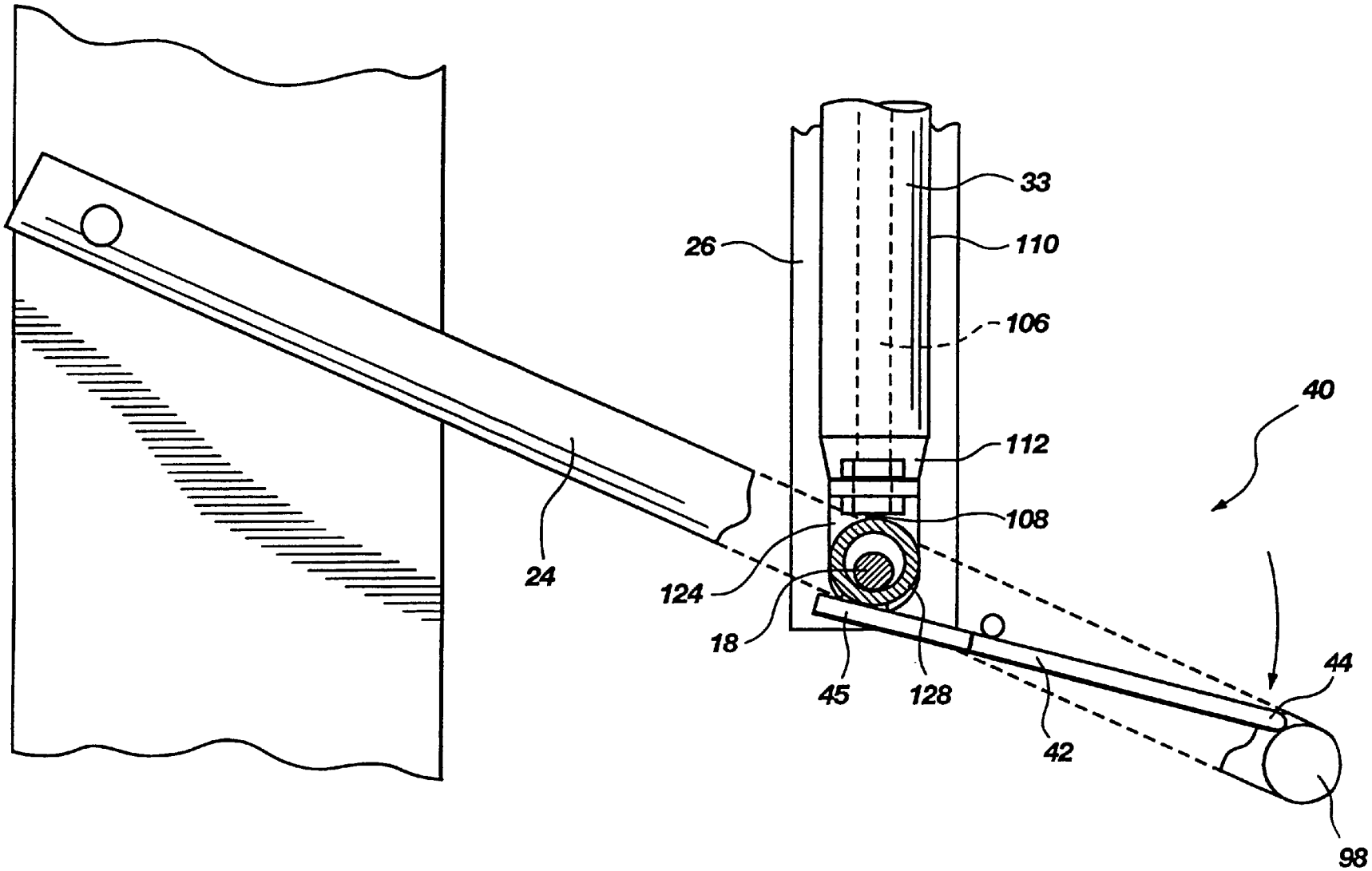
FIG. 6 is a partially cut away, side cross sectional view of the adjustment lever of FIG. 5 with the actuation trigger in the actuated position.

Referring now to FIGS. 5 and 6, the adjustable basketball goal system 10 includes releasing means 40 for moving the restricting means 32 from the engaged position to the disengaged position. In a presently preferred embodiment, the releasing means 40 includes an actuation trigger 42 pivotally attached to the adjustment lever 24. The actuation trigger 42 includes a first end 44 and a second end 45. The actuation trigger 42 is preferably pivotally attached to the adjustment lever 24 between the first end 44 and the second end 45. The first end 44 of the actuation trigger 42 is preferably positioned adjacent a first end 25 of the adjustment lever 24 which in the preferred embodiment is the curved section 98. This configuration allows a person to engage the actuation trigger 42 and the adjustment lever 24 with the same hand. In the embodiment illustrated in FIGS. 5 and 6, the first end 44 of the actuation trigger 42 is preferably positioned above the first end 25 of the adjustment lever 24 such that the first end 44 of the actuation trigger 42 can not pivot below the first end 25 of the adjustment lever 24. In this configuration, a person can not hang from the first end 44 of the actuation trigger 42 which may cause the actuation trigger 42 to bend or break.

The second end 45 of the actuation trigger 42 is positioned adjacent the switch 108 such that as the first end 44 is depressed, the second end 45 pivots into engagement with the switch 108 forcing the switch 108 into the unlocked position. In a presently preferred embodiment, the second end 45 is configured with a tube member 128. The bolt 18 which pivotally attaches the extension arm 26 to the adjustment lever 24 passes through the tube member 128. The tube member 128 has an inner diameter which is larger than the outer diameter of the bolt 18, thus defining a range of pivotal motion for the actuation trigger 42.

It will be appreciated by those of skill in the art that the difference between the inner diameter of the tube member 128 and the diameter of the bolt 18 allows for slight lateral movement of the tube member 128 with respect to the bolt 18. This configuration allows the switch 108 to slide along an outer surface 129 of the tube member 128 while the adjustment lever 24, thus allowing the actuation trigger to remain in an actuation position (FIG. 6) with the switch 108 in the locked position, through the full range of motion of the adjustment lever 24.

As can be seen with reference to FIG. 3, the tube member 128 is preferably positioned within the U-shaped mounting piece 124. As discussed above, the switch 108 is biased in the locked position in which the switch 108 projects outwardly. The outward bias of the switch 108 in turn keeps the actuation trigger 42 in a rest position (FIG. 5) until the first end 44 of the actuation trigger 42 is depressed forcing the actuation trigger 42 into an actuated position (FIG. 6) in which the tube member 128 engages the switch 108 and overcomes the outward bias of the switch 108 unlocking the piston assembly 33.

It will be appreciated by those of skill in the art that the actuation trigger 42 may have independent biasing means to keep the actuation trigger 42 in the rest position. It will further be appreciated that the actuation trigger 42 can be configured in a variety of ways in order to release the restricting means 32. For example, if the lockable piston assembly 33 is positioned away from the adjustment lever 24, the actuation trigger 42 may include a cable or other mechanism to move the switch 108 from the locked position to the unlocked position. Further, if the adjustable basketball goal system 10 is counterbalanced using a spring instead of the lockable piston assembly 33, the trigger may include a rod biased to engage a series of openings in the rigid support 22, thus locking the adjustment lever 24 in place until the rod is removed from one of the openings. It will be appreciated by those of skill in the art that it is preferable to configure the actuation trigger 42 such that the actuation trigger 42 can remain in the actuation trigger 42 throughout the desired range of motion of the adjustment lever 24.

With reference now to FIGS. 2 and 4, the adjustable basketball goal system 10 includes at least one adjustment stop and preferably at least one upper adjustment stop 130 and at least one lower adjustment stop 132 attached to the rigid support 22. The upper adjustment stop 132 is positioned on the rigid support 22 such that when the basketball goal 48 is at a predetermined highest position above the playing surface, the first parallelogrammic structure 12 engages the upper adjustment stop 132 thereby preventing the basketball goal 48 from being positioned higher than the predetermined highest position. The lower adjustment stop 130 is positioned on the rigid support 22 such that when the basketball goal 48 is at a predetermined lowest position above the playing surface, the first parallelogrammic structure 12 engages the lower adjustment stop 130 thereby preventing the basketball goal 48 from being positioned below the predetermined lowest position.

In a presently preferred embodiment, the upper adjustment stop 132 is positioned below the lower support 60 and the lower adjustment stop 130 is positioned above the lower support 60. The lower and upper adjustment stops 130 and 132 define a range of heights in which the basketball goal 48 may be positioned. In one embodiment, the adjustment stops 130 and 132 are positioned on the rigid support 22 to define a range of heights between about 7 feet and about 10 feet. In a preferred embodiment, the adjustment stops 130 and 132 are positioned on the rigid support 22 to define a range of heights between 7½ feet and 10 feet.

It will be appreciated that one or more adjustment stops may be positioned to engage the upper and/or lower supports 58 and 60 and/or the adjustment lever 24 to practice the teachings of this invention. It will further be appreciated by those of skill in the art that the adjustment stops 130 and 132 provide a safety function by prohibiting the basketball goal 48 from crashing down upon a player. The adjustment stops can further be positioned to correspond to a predetermined height such as the standard height of 10 feet, thereby allowing the basketball goal 48 to be easily positioned at that height.

Referring now to FIGS. 4, 5, and 6, the adjustable basketball goal system 10 is utilized by grasping the adjustment lever 24 and simultaneously depressing the actuation trigger 42 with the same hand. This unlocks the lockable piston assembly 33. The adjustment lever 24 can then be moved which deforms the first deformable parallelogrammic structure 12, repositioning the height of the basketball goal 48 above the playing surface. Once the basketball goal 48 is at the desired height, the actuation trigger 42 is released, locking the lockable piston assembly 33 and preventing the basketball goal 48 from further movement. The same steps are followed to reposition the basketball goal 48.

Figure 7:
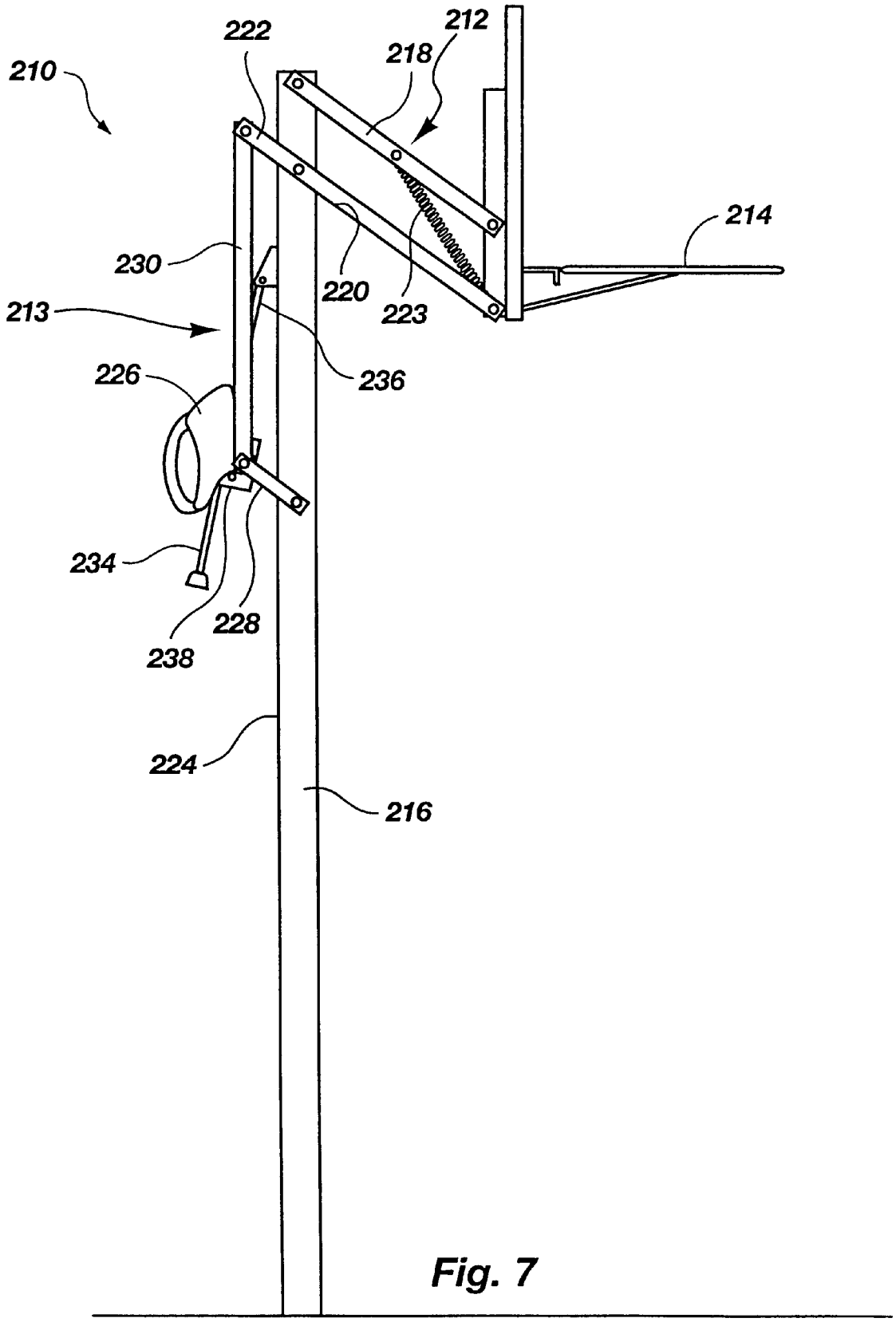
FIG. 7 is a side plan view of one embodiment of the adjustable basketball goal system of the present invention.

With reference now to FIG. 7, another embodiment of the adjustable basketball goal system according to the present invention is generally designated at 210. The goal system 210 includes a first deformable parallelogrammic structure 212 which can be deformed into a plurality of configurations such that at each configuration a basketball goal 214 is disposed at a different height above the playing surface. The goal system 210 includes means for securing the first deformable parallelogrammic structure 212 to a rigid support 216 such that the first parallelogrammic structure 212 is suspended above the playing surface, and means for attaching the basketball goal 214 to the first parallelogrammic structure 212. The first parallelogrammic structure 212, means for attaching the first parallelogrammic structure 212 to the rigid support 216, and means for attaching the basketball goal 214 to the first parallelogrammic structure 212 are substantially the same as in the embodiment illustrated in FIGS. 1 through 6 and are described in detail above.

The goal system 210 also includes a second deformable parallelogrammic structure 213, which can be deformed into a plurality of configurations such that at each configuration the first deformable parallelogrammic structure 212 is disposed at a different configuration and the basketball goal 214 is correspondingly disposed at a different height above the playing surface. The goal system 210 further includes a connecting assembly for securing the second deformable parallelogrammic structure 213 between a rigid support 216 and the first deformable parallelogrammic structure 212. The second parallelogrammic structure 213 and connecting assembly are substantially the same as in the embodiment illustrated in FIGS. 1 through 6 and are described in detail above.

In the preferred embodiment illustrated in FIG. 7, the first parallelogrammic structure 212 includes an upper support 218 and a lower support 220. At least one of the these supports 218 and 220, includes a tail section 222 which extends beyond the rigid support 216 at the back side 224 of the rigid support 216. The tail section 222 provides a place to link the first parallelogrammic structure 212 to an adjustment handle 226, which is preferably pivotally mounted adjacent the back side 224 of the rigid support 216 below the first parallelogrammic structure 212 by means of a stabilizing arm 228. Being located on the back side 224 of the rigid support 216, the adjustment handle 226 is less likely to interfere with basketball play. The adjustment handle 226 is linked to the first parallelogrammic structure by an extension arm 230, which is part of the second deformable parallelogrammic structure 213. As shown, the tail section 222 of one or more of the supports 218, 220, the stabilizing arm 228, at least a portion of the length of the rigid support 216, and the extension arm 230 preferably define the second deformable parallelogrammic structure 213 of one presently preferred embodiment of the present invention.

The extension arm 230 of the embodiment of FIG. 7 is substantially similar to the extension arm illustrated in the embodiment of FIGS. 1 through 6 as described above. The positioning of the extension arm 230 relative to the first parallelogrammic structure 212 and the adjustment handle 226 (the adjustment lever in the embodiment of FIGS. 1 through 6) is more fully described above.

The adjustable basketball goal system 210 is counterbalanced with counterbalancing spring 223 disposed within the parallelogrammic 212 structure to thereby provide a force which substantially counterbalances the gravitational force acting on the adjustable basketball goal system due to the weight of the basketball goal. This allows for adjustment of the height of the basketball goal 214 above the playing surface with minimal effort. As discussed in detail above, there are various alternative ways to counterbalance the adjustable basketball goal system 210 of the present invention.

The basketball goal system 210 includes a locking rod 234. The locking rod 234 is pivotally attached at a first end 236 to the rigid support 216, by means of a bracket 232. The locking rod 234 is positioned within an opening 248 configured in a U-shaped housing 238 adjacent a second end 237 of the locking rod 234. The locking rod 234 slidably engages the U-shaped housing 238. In the preferred embodiment, the first end 236 of the locking rod 234 is positioned above the second end 237 of the locking rod. In this configuration, the second end 237 of the locking rod 234 is pointing downward and is less likely to become entangled with users of the basketball goal system 210 or other bystanders.

Figure 8:
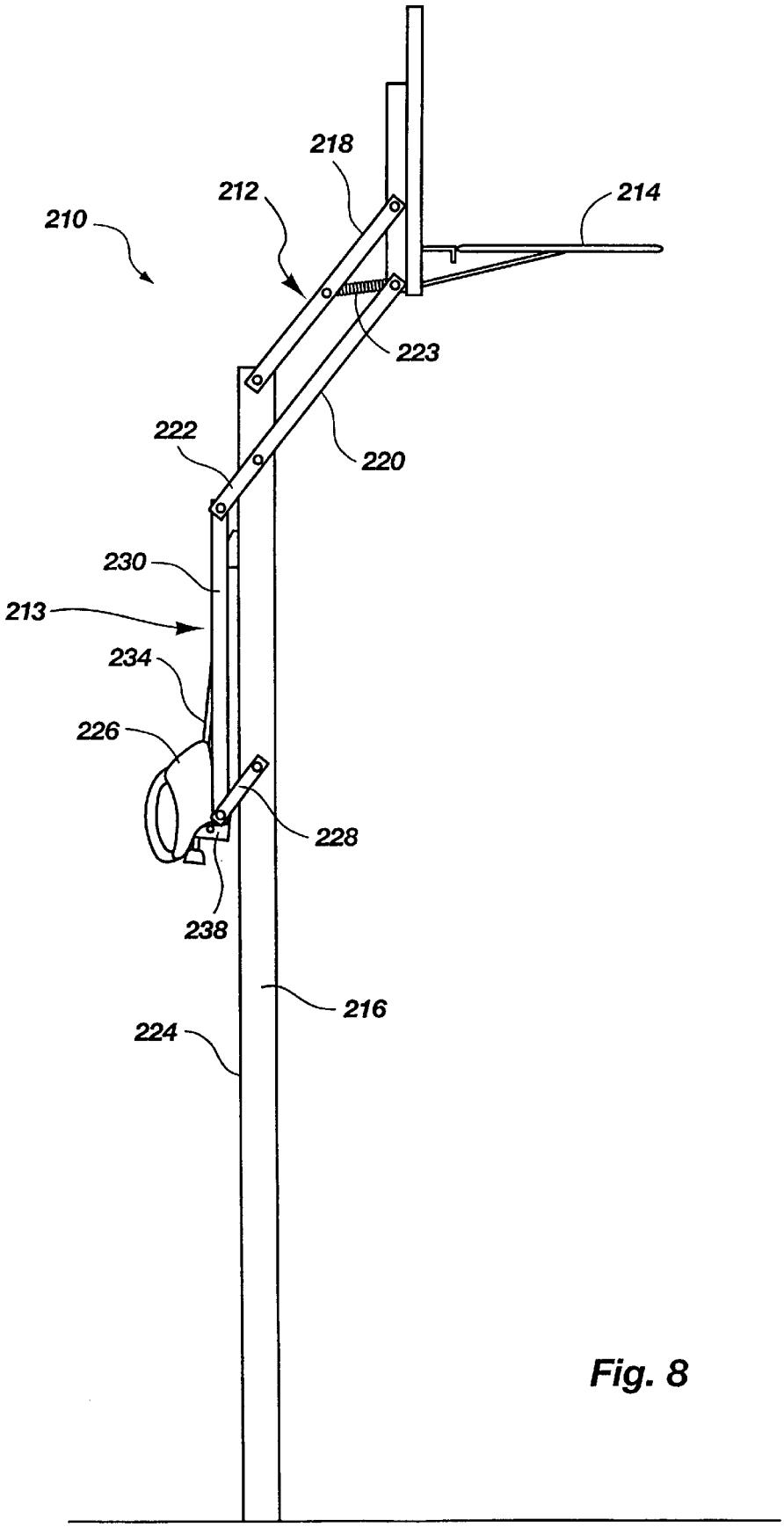
FIG. 8 is a side plan view of the adjustable basketball goal system of FIG. 7 with the basketball goal positioned at a different height above the playing surface.

In a preferred embodiment the extension arm 230 is pivotally attached to the housing 238 at a pivot point 260. The stabilizing arm 228 and adjustment handle 226 are also pivotally attached to the housing 238 at the pivot point 260 (the housing 238 and adjustment handle 226 are more fully described below). As can best be seen by simultaneous reference to FIGS. 7 and 8, in this configuration, the adjustment handle 226 can be used to slide the housing 238 along the locking rod 234. This action moves the extension arm 230 thereby deforming both the second parallelogrammic structure 213 and the first parallelogrammic structure 212, and, accordingly, providing means for adjusting the height of the basketball goal 214 above the playing surface.

Figure 9:
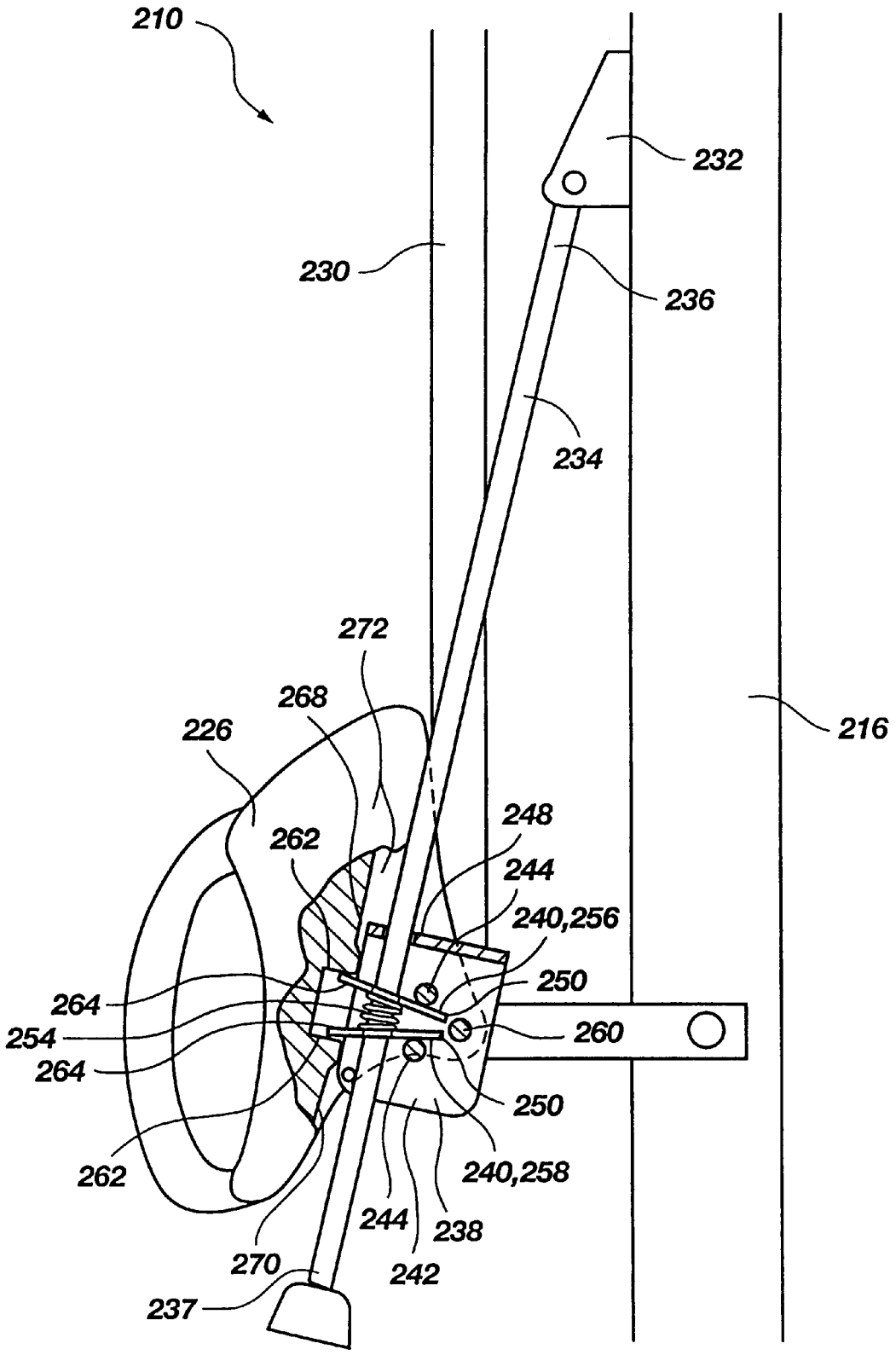
FIG. 9 is a partially cut away, side cross sectional view of the adjustment handle and housing of the adjustable basketball goal system of FIG. 7.

With reference now to FIG. 9, at least one locking plate 240, and preferably two locking plates 240 are positioned within the housing 238. The locking plates 240 of the preferred embodiment are flat rectangular pieces of substantially uniform thickness. The locking plates 240 are each configured with an opening (not shown) through which the locking rod 234 is positioned. These openings are larger than the diameter of the locking rod 234. It will be appreciated by those of skill in the art that this configuration allows the locking plates 240 to be positioned in a non-perpendicular angle relative to the locking rod 234. It will also be appreciated by those of skill in the art that when the plates 240 are biased in a non-perpendicular angle relative to the locking rod 234, the locking plates 240 will bind with the locking rod 234, preventing the locking rod from moving, relative to the plates 240. It will further be appreciated by those of skill in the art, that a variety of locking plate 240 and locking rod 234 configurations can be used to accomplish this binding effect. For example the locking plates 240 could be elliptical or of varying thickness. The opening could also be of varying configurations depending on the configuration of the locking rod 234. Of importance is that edge or edges of the opening in locking plates 240 be such that the locking plates 240 can be angled for frictional engagement with the locking rod 234 to cause binding, while being capable of positioning for clearance of the locking rod 234 through the locking plates 240. It will further be appreciated that one or more plates 240 may be used to accomplish the teachings of this invention.

The locking plates 240 are secured within the housing 238. With brief reference to FIG. 10, the plates 240 are positioned between opposing sides 242 of the U-shaped housing 238. In this configuration, the locking plates 240 are prevented from moving laterally or rotating about the locking rod 234. Referring again to FIG. 9, the housing 238 includes at least one stop 244, and preferably two stops 244. The stops are each disposed between and attached to the opposing sides 242 of the U-shaped housing 238. The stops 244 are positioned within the housing on the opposite side of the locking rod 234 from the adjustment handle 226. Each stop 244 is preferably positioned to engage a first end 250 of one of the locking plates 240. In one embodiment, the locking plates 240 are biased into a non-perpendicular or "binding" angle relative to the locking rod 234 by means of a biasing member 254. In a preferred embodiment, the biasing member 254 is a spring. The spring 254 is positioned about the locking rod 234 between the locking plates 240. As the spring 254 engages each locking plate 240, the locking plates 240 pivot about respective stops 244 into a non-perpendicular binding position relative to the locking rod 234.

As can be seen in FIG. 9, the locking plates 240 are preferably angled away from each other. One of skill in the art will appreciate that in this configuration, an upper locking plate 240, 256 will tend to bind with the locking rod 234 as the housing 238 is moved in the downward direction and a lower locking plate 240, 258 will tend to bind with the locking rod 234 as the housing 238 is moved in the upward direction.

It will be appreciated by those of skill in the art that a variety of biasing members 254 may used in a variety of configurations to urge the locking plates 240 into non-perpendicular angles relative to the locking rod 234 thereby permitting the locking rod 234 to bind with the locking plates 240. One such alternative embodiment includes pliable metal disposed between the locking plates 240. In this configuration, the locking plates 240 and the pliable metal could be one unitary piece. The variety of biasing member 254 configurations depends in large part on the variety of housing 238 configurations that may be employed. For example, the stops 244 may be positioned in different locations requiring the biasing member to be positioned in different locations to cause the required "binding" angle of the locking plate 240 relative to the locking rod 234. In one embodiment, the stops 244 could be positioned adjacent the adjustment handle. In order to have the biasing member 254 exert the same pivoting force on the locking plates 240, a biasing member would necessarily need to be positioned on the other side of each locking plate 240.

The combination of the locking rod 234 positioned through openings in the locking plates 240, the stops 244, and the spring 254 biasing the locking plates 240 against the stops 244, secures the locking plates 240 within the housing 238. Thus, the housing 238 is prevented from moving relative to the locking rod 234. Consequently, the extension arm 230 remains stationary until the system 210 is unlocked and thus, the basketball goal 214 may be maintained at a predetermined height during basketball play.

Referring still to FIG. 9, adjustment of the basketball goal 214 is accomplished through the use of the adjustment handle 226. The adjustment handle 226 is pivotally attached to the housing 238 at a pivot point 260. The adjustment handle 226 is configured to move between a rest position, wherein each locking plate 240 is in a non-perpendicular position relative to the locking rod 234 and an engaged position, wherein a portion of the adjustment handle 226 engages at lease one locking plate 240 forcing it into a substantially perpendicular position relative to the locking rod 234. In a presently preferred embodiment, the adjustment handle 226 is configured with at least one locking tab 262 and preferably a pair of tabs 262. Each tab 262 is configured to engage a second end 264 of a respective locking plate 240 and move the locking plate 240 into a substantially perpendicular angle relative to the locking rod 234 when the adjustment handle 226 is rotated to an engaged position.

It will be appreciated by those of skill in the art that when the locking plate 240, angled to create a binding effect on the locking rod 234, is moved into a substantially perpendicular position relative to the locking rod 234, the locking rod 234 will be allowed to pass through the opening 248 in the locking plate 240 without binding. For example, with reference now to FIG. 11, as the adjustment handle 226 is pivoted upward in the direction of arrow A into a first engaged position, a lower tab 262, 266 engages the second end 264 of the lower locking plate 240, 258 moving the lower locking plate 240, 258 into a substantially perpendicular position relative to the locking rod 234. Because the lower locking plate 240, 258 is the only locking plate 240 creating a binding effect on the locking rod 234 when the housing 238 is moved upward in the direction of arrow B, the housing is now permitted to slide upward along the locking rod 234, thereby moving the extension arm 230 upward. This in turn deforms the second parallelogrammic structure 213 and, correspondingly, the first parallelogrammic structure 212 thereby repositioning the height of the basketball goal 214 above the playing surface.

Figure 12:
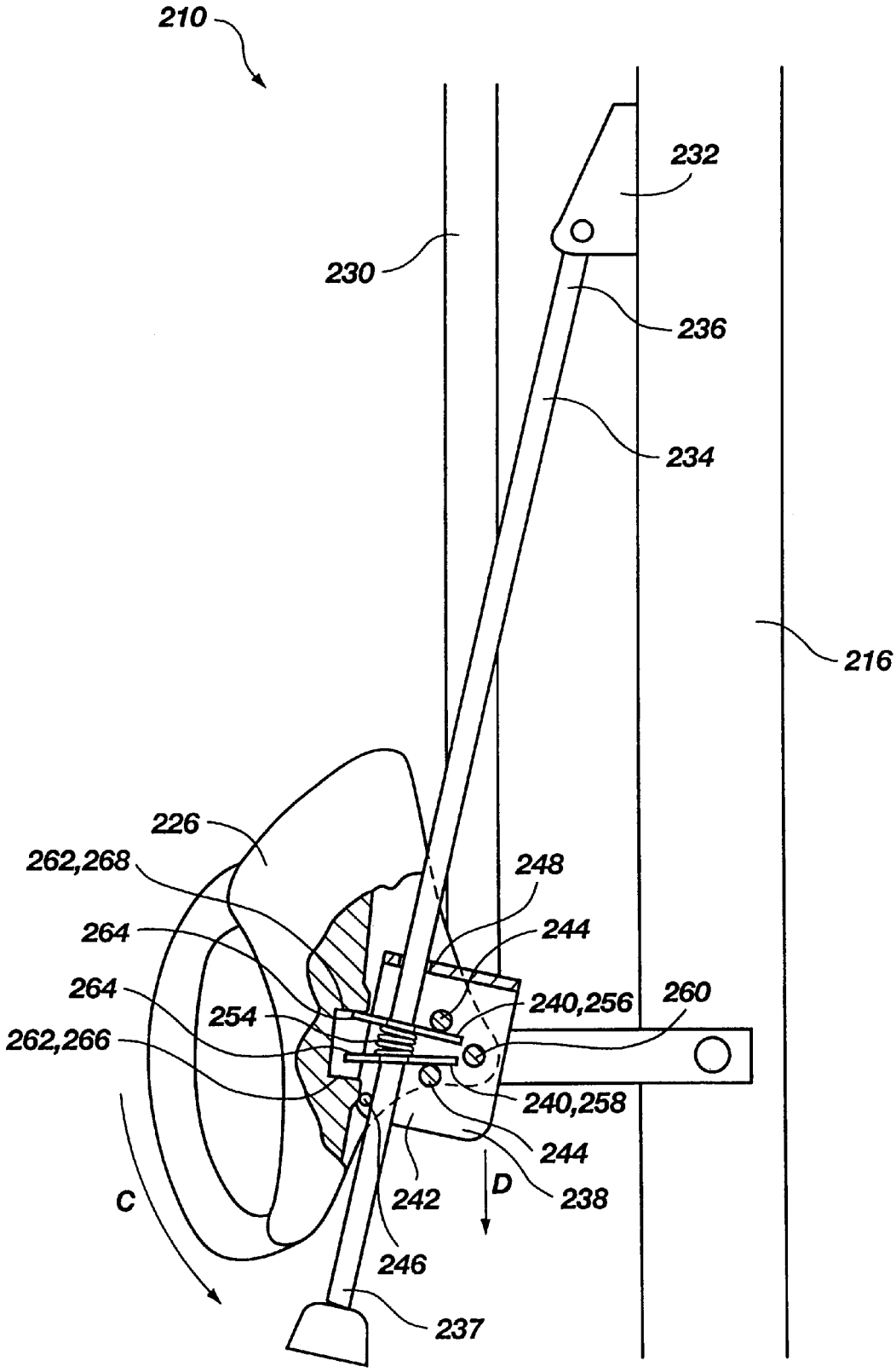
FIG. 12 is a partially cut away, side cross sectional view of the adjustment handle and housing of the adjustable basketball goal system of FIG. 7 with the adjustment handle in the down position.

Likewise, with reference now to FIG. 12, as the adjustment handle 226 is pivoted downward in the direction of arrow C into a second engaged position, an upper tab 262, 268 engages the second end 264 of the upper locking plate 240, 256 moving the upper locking plate 240, 256 into a substantially perpendicular position relative to the locking rod 234. Because the upper locking plate 240, 256 is the only locking plate 240 creating a binding effect on the locking rod 234 when the housing is moved downward in the direction of arrow D, the housing 238 is permitted to slide downward along the locking rod 234, thereby moving the extension arm 230 downward. This in turn deforms both the second parallelogrammic structure 213 and the first parallelogrammic structure 212, thus repositioning the height of the basketball goal 214 above the playing surface.

It will be appreciated by those of skill in the art that the adjustment handle 226 can be configured in a variety of ways to release the binding effect of the locking plates 240 on the locking rod 234. One such way is to secure a cross-member to the locking plates 240. The cross-member could extend outwardly through openings in the handle 226 such that as the handle 226 is pivoted, the openings in the handle 226 would engage the cross-member which would in turn move the locking plate 240 into a substantially perpendicular position relative to the locking rod 234. This would obviate the need for tabs 262.

With reference again to FIG. 9, the adjustment handle 226 comprises a first abutment portion 268 configured to engage the housing 238 at the first engaged position and a second abutment portion 270 configured to engage the housing 238 at the second engaged position. In this configuration, the abutment portions 268 and 270 define a range of motion for the adjustment handle 226. It will be appreciated that the adjustment handle 226 can be configured in a variety of ways to limit the pivotal range of motion of the handle 226.

The adjustment handle 226 also includes side walls 272. These side walls 272 are configured to snugly fit around the outside of the U-shaped housing 238. In this configuration, the side walls 272 provide a surface for attaching the adjustment handle 226 to the housing 238 at the pivot point 260 without interfering with the interaction of the locking plates 240 with the biasing member 254, or with the locking rod 234. The side walls 272 also offer a measure of protection for this interaction. It will be appreciated by those of skill in the art that the teachings of this invention can be practiced using a variety of adjustment handle 226 configurations.

Figure 10:
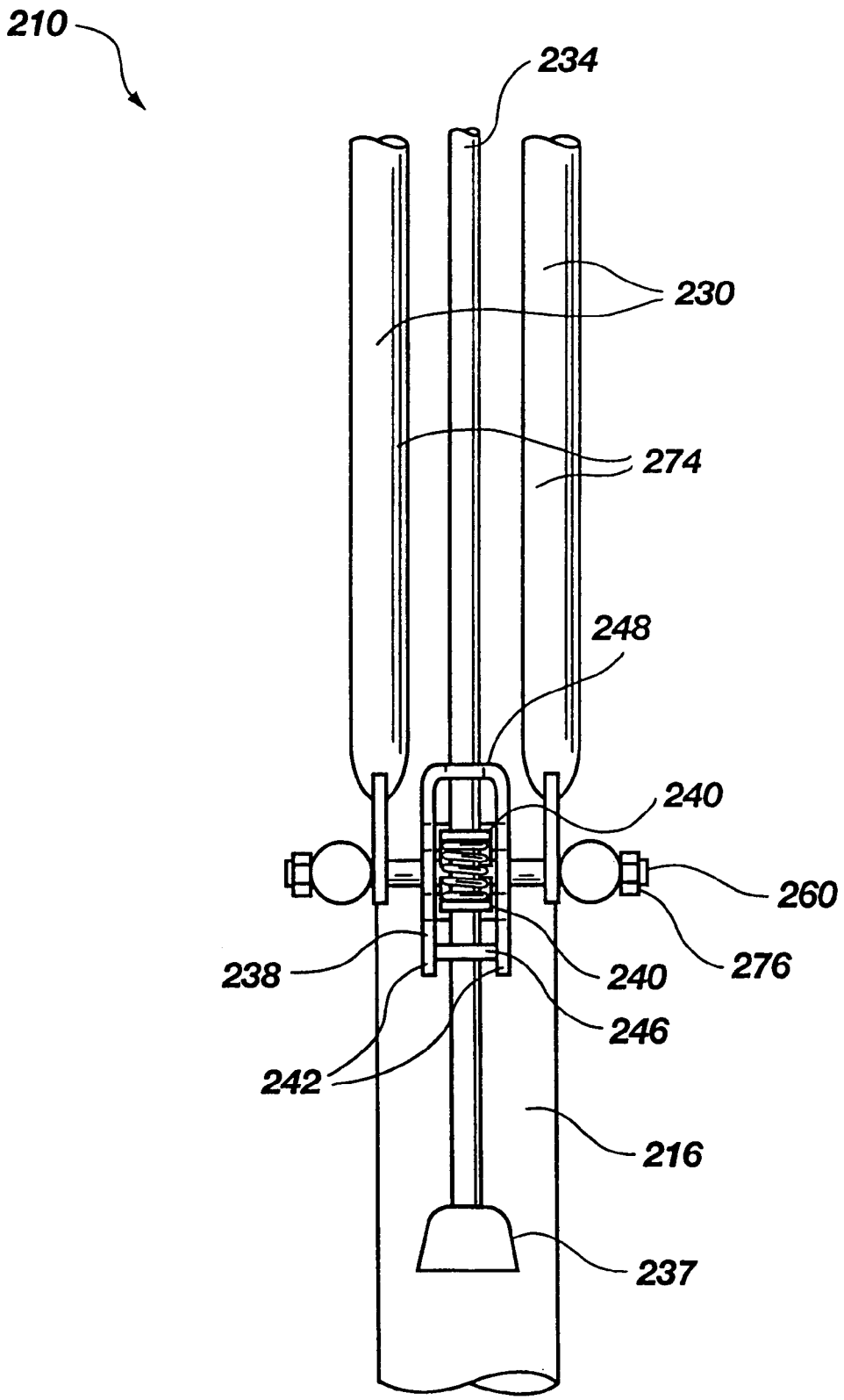
FIG. 10 is a back plan view of the adjustable basketball goal system of FIG. 7 without the adjustment handle.

With reference now to FIG. 10, a back plan view of one preferred embodiment of the adjustable basketball goal system 210 is shown without the adjustment handle 226. The locking rod 234 is positioned between parallel members 274 of the extension arm 230. In one preferred embodiment, the extension arm 230 is pivotally attached to the housing 238, the adjustment handle (not shown), and the stabilizing arm (not shown) at the pivot point 260 by means of a pivot rod 276. The housing 238 is configured with at least one bushing 246 which serves to guide the movement of the housing 238 relative to the locking rod 234. It will be appreciated by those of skill in the art that a roller or other guide may be used instead of a bushing to aid in the slidable engagement of the housing 238 with the locking rod 234.

Figure 11:
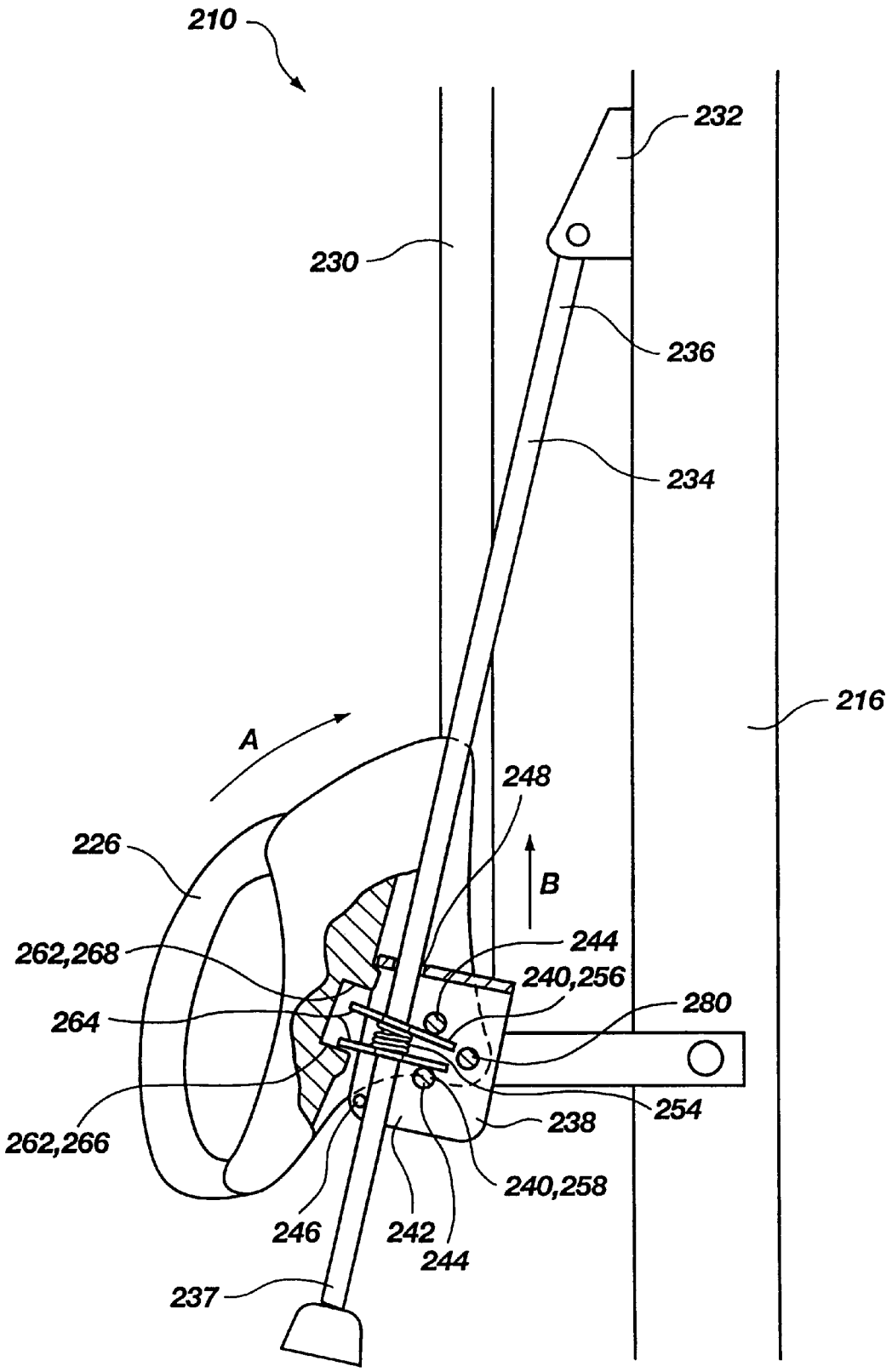
FIG. 11 is a partially cut away, side cross sectional view of the adjustment handle and housing of the adjustable basketball goal system of FIG. 7 with the adjustment handle in the up position.

Referring now to FIG. 11, when the system is in a "rest" position the locking plates 240 prevent the housing 238 from moving with respect to the locking rod 234. Thus, the extension arm 230 remains still and consequently, the basketball goal 214 remains in a stationary position above the playing surface. To adjust the basketball goal downwardly, the adjustment handle 226 is pivoted in the direction of arrow A. This releases the binding effect of the lower locking plate 240, 258 and the adjustment handle 226 can be moved upward in the direction of arrow A, bringing with it the extension arm 230. This causes the basketball goal 214 to lower (See FIG. 7). Referring now to FIG. 12, to adjust the basketball goal upwardly, the adjustment handle 226 is pivoted in the direction of arrow C. This releases the binding effect of the upper locking plate 240, 256 and the adjustment handle 226 can be moved downward in the direction of arrow D, bringing with it the extension arm 230. This causes the basketball goal 214 to raise (See FIG. 8). Thus, the adjustable basketball goal system of the preferred embodiment can be "unlocked" and adjusted easily with the use of the same hand.

It should be appreciated that the apparatus and methods of the present invention are capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An adjustable basketball goal system allowing for adjustment of the height of a basketball goal above a playing surface, comprising:

a rigid support;

a first parallelogrammic structure configured to pivotally engage said rigid support, said first parallelogrammic structure being deformable into a plurality of configurations wherein at each configuration said basketball goal is disposed at a different height above said playing surface; and a second parallelogrammic structure having a first end pivotally connected to said first parallelogrammic structure and a second opposing end configured to pivotally engage said rigid support, wherein selective deformation of said second parallelogrammic structure selectively deforms said first parallelogrammic structure into said plurality of configurations.

2. The adjustable basketball goal system as defined in claim 1, wherein said second parallelogrammic structure comprises an extension arm having a proximal end and a distal end, said proximal end connected to said first parallelogrammic structure and said distal end configured to pivotally engage said rigid support, wherein movement of said extension arm selectively deforms said first parallelogrammic structure.

3. The adjustable basketball goal system as defined in claim 1, further comprising a locking mechanism operably disposed relative to said second parallelogrammic structure, said locking mechanism having an engaged position wherein the second parallelogrammic structure is restricted from deforming and a disengaged position wherein the second parallelogrammic structure may be freely deformed.

4. The adjustable basketball goal system as defined in claim 3, wherein said locking mechanism comprises a locking rod attached to said rigid support.

5. The adjustable basketball goal system as defined in claim 4, further comprising at least one locking plate selectively engaging said locking rod.

6. The adjustable basketball goal system as defined in claim 5, further comprising a housing disposed in cooperation with said locking rod.

7. The adjustable basketball goal system as defined in claim 6, wherein said locking plate is positioned within said housing.

8. The adjustable basketball goal system as defined in claim 7, wherein said housing comprises a stop positioned to engage said locking plate.

9. The adjustable basketball goal system as defined in claim 4, wherein said locking rod moves relative to said second parallelogrammic structure.

10. The adjustable basketball goal system as defined in claim 3, further comprising a release adapted to assist in disposing said locking mechanism between said engaged position and said disengaged position.

11. The adjustable basketball goal system as defined in claim 5, wherein said release comprises at least one tab, said tab selectively engaging said locking plate wherein urging the locking plate into a substantially perpendicular position relative to said locking rod.

12. The adjustable basketball goal system as defined in claim 5, further comprising a biasing member positioned to bias said locking plate into a non-perpendicular angle relative to said locking rod, thereby permitting the locking plate to bind in relation to the locking rod.

13. The adjustable basketball goal system as defined in claim 5, further comprising a second locking plate selectively engaging said locking rod.

14. An adjustable basketball goal system allowing for adjustment of the height of a basketball goal above a playing surface, comprising:

a first parallelogrammic structure configured to pivotally engage said rigid support, said first parallelogrammic structure being deformable into a plurality of configurations wherein at each configuration said basketball goal is disposed at a different height above said playing surface;

a second parallelogrammic structure having a first end pivotally connected to said first parallelogrammic structure and a second opposing end configured to pivotally engage said rigid support, wherein selective deformation of said second parallelogrammic structure selectively deforms said first parallelogrammic structure into said plurality of configurations; and a locking mechanism operably disposed relative to said second parallelogrammic structure, said locking mechanism having an engaged position wherein the second parallelogrammic structure is restricted from deforming and a disengaged position wherein the second parallelogrammic structure may be freely deformed.

15. The adjustable basketball goal system as defined in claim 14, wherein said second parallelogrammic structure comprises an extension arm having a proximal end and a distal end, said proximal end connected to said first parallelogrammic structure and said distal end configured to pivotally engage said rigid support, wherein movement of said extension arm selectively deforms said first parallelogrammic structure.

16. The adjustable basketball goal system as defined in claim 15, wherein said locking mechanism comprises a locking rod attached to said rigid support.

17. The adjustable basketball goal system as defined in claim 16, further comprising at least one locking plate selectively engaging said locking rod.

18. The adjustable basketball goal system as defined in claim 17, further comprising a housing disposed in cooperation with said locking rod.

19. The adjustable basketball goal system as defined in claim 18, wherein said locking plate is positioned within said housing.

20. The adjustable basketball goal system as defined in claim 19, wherein said housing comprises a stop positioned to engage said locking plate.

21. The adjustable basketball goal system as defined in claim 16, wherein said locking rod moves relative to said second parallelogrammic structure.

22. The adjustable basketball goal system as defined in claim 14, further comprising a release adapted to assist in disposing said locking mechanism between said engaged position and said disengaged position.

23. The adjustable basketball goal system as defined in claim 22, wherein said release comprises at least one tab, said tab selectively engaging said locking plate wherein urging the locking plate into a substantially perpendicular position relative to said locking rod.

24. The adjustable basketball goal system as defined in claim 23, further comprising a biasing member positioned to bias said locking plate into a non-perpendicular angle relative to said locking rod, thereby permitting the locking plate to bind in relation to the locking rod.

25. The adjustable basketball goal system as defined in claim 17, further comprising a second locking plate selectively engaging said locking rod.

26. A method for adjusting the height of a basketball goal system above a playing surface, said basketball goal system having a first parallelogrammic structure configured to pivotally engage a rigid support, said first parallelogrammic structure being deformable into a plurality of configurations above said playing surface, and a second parallelogrammic structure having a first end pivotally connected to the first parallelogrammic structure and a second opposing end configured to pivotally engage said rigid support, said method comprising the steps of:

disengaging said second parallelogrammic structure from a first position;

deforming said second parallelogrammic structure to deform said first parallelogrammic structure in one of said plurality of configurations; and engaging said second parallelogrammic structure into a second position.

27. The adjustable basketball goal system as defined in claim 26, wherein said second parallelogrammic structure comprises an extension arm having a proximal end and a distal end, said proximal end connected to said first parallelogrammic structure and said distal end configured to pivotally engage said rigid support, wherein movement of said extension arm selectively deforms said first parallelogrammic structure.

28. The method as defined in claim 26, wherein said basketball goal system further comprises a locking mechanism operably disposed in relation to said second parallelogrammic structure for locking said deformation of the second parallelogrammic structure at said second position.

29. The method as defined in claim 26, wherein said steps of disengaging said second parallelogrammic structure from said first position, deforming said second parallelogrammic structure, and engaging said second parallelogrammic structure into said second position can be performed using a single hand of a user.

* * * * *

UNITED STATES PATENT AND TRADEMARK OFFICE

CERTIFICATE OF CORRECTION

PATENT NO. : 6,419,598 B1 
DATED : July 16, 2002
INVENTOR(S) : David C. Winter, Edward G. van Nimwegen and Coplan E. Vaughan It is certified that error appears in the above-identified patent and that said Letters Patent is hereby corrected as shown below:

Column 5,
Line 10, change “filly” to -- fully --

Column 8,
Line 4, change “crosssection” to -- cross-section --
Line 58, delete “15”

Column 10,
Line 43, change “sidably” to -- slidably --
Last two paragraphs should be one paragraph Column 16,
Line 56, after “may” insert -- be --

Signed and Sealed this

Tenth Day of December, 2002

JAMES E. ROGAN
*Director of the United States Patent and Trademark Office*